US010961663B2

(12) United States Patent
Bushhouse et al.

(10) Patent No.: US 10,961,663 B2
(45) Date of Patent: Mar. 30, 2021

(54) PAPERBOARD WITH LOW COAT WEIGHT AND HIGH SMOOTHNESS

(71) Applicant: WestRock MWV, LLC, Norcross, GA (US)

(72) Inventors: Steven G. Bushhouse, Quinton, VA (US); Gary P. Fugitt, Rockville, VA (US); Scott E. Ginther, Moseley, VA (US)

(73) Assignee: WestRock MWV, LLC, Atlanta, GA (US)

( * ) Notice: Subject to any disclaimer, the term of this patent is extended or adjusted under 35 U.S.C. 154(b) by 151 days.

(21) Appl. No.: 15/809,008

(22) Filed: Nov. 10, 2017

(65) Prior Publication Data

US 2018/0209098 A1 Jul. 26, 2018

Related U.S. Application Data

(60) Provisional application No. 62/450,586, filed on Jan. 26, 2017, provisional application No. 62/450,191, filed on Jan. 25, 2017.

(51) Int. Cl.

| | |
|---|---|
| ***D21H 19/58*** | (2006.01) |
| ***D21H 19/42*** | (2006.01) |
| ***D21J 1/08*** | (2006.01) |
| ***D21H 19/38*** | (2006.01) |
| ***D21H 19/40*** | (2006.01) |

(52) U.S. Cl.

CPC ..... *D21H 19/58* (2013.01); *D21H 19/385* (2013.01); *D21H 19/40* (2013.01); *D21H 19/42* (2013.01); *D21J 1/08* (2013.01)

(58) Field of Classification Search

CPC ..... D21H 19/58; D21H 19/36; D21H 19/42; D21H 19/64

USPC ..... 428/330

See application file for complete search history.

(56) References Cited

U.S. PATENT DOCUMENTS

| | | | | |
|---|---|---|---|---|
| 8,142,887 | B2 | 3/2012 | Fugitt et al. | |
| 2004/0099391 | A1 | 5/2004 | Ching | |
| 2005/0031805 | A1* | 2/2005 | Fugitt | B41M 5/42 428/32.34 |
| 2008/0311416 | A1* | 12/2008 | Kelly | D21H 21/54 428/537.5 |
| 2009/0236062 | A1 | 9/2009 | Fugitt | |
| 2009/0239047 | A1* | 9/2009 | Fugitt | C09C 1/0081 428/207 |
| 2010/0266819 | A1 | 10/2010 | Bushhouse | |

(Continued)

FOREIGN PATENT DOCUMENTS

| | | | |
|---|---|---|---|
| EP | 0825296 | A1 | 2/1998 |
| WO | WO98/20201 | A1 | 5/1998 |

(Continued)

*Primary Examiner* — Jane L Stanley

(74) *Attorney, Agent, or Firm* — Walters & Wasylyna LLC

(57) ABSTRACT

Coatings are disclosed which provide single-layer-coated paperboard having good smoothness and printability. Low density organic pigments (LDOP) are used in some of the coatings. Certain coatings when applied as single-layer coatings at 6 lb/3000 $ft^2$ (9.8 $g/m^2$) and higher gave Parker PrintSurf values less than 2.5 microns. Certain coatings when applied as base coats and then top coated gave PrintSurf values less than 2.0 microns for uncalendered samples.

21 Claims, 20 Drawing Sheets

(56) References Cited

U.S. PATENT DOCUMENTS

| | | | | |
|---|---|---|---|---|
| 2011/0244205 | A1* | 10/2011 | Fugitt | D21H 19/36<br>428/219 |
| 2019/0211506 | A1* | 7/2019 | Fugitt | D21H 19/40 |
| 2019/0218719 | A1* | 7/2019 | Bushhouse | D21H 19/38 |

FOREIGN PATENT DOCUMENTS

| | | | |
|---|---|---|---|
| WO | WO99/63157 | A1 | 12/1999 |
| WO | WO2004/114014 | A1 | 12/2004 |

* cited by examiner

PAPERBOARD WITH LOW COAT WEIGHT AND HIGH SMOOTHNESS

REFERENCE TO RELATED APPLICATIONS

This application claims the benefit of priority under 35 U.S.C. § 119(e) of U.S. provisional applications Ser. No. 62/420,586 filed on Nov. 11, 2016 and Ser. No. 62/450,191 filed on Jan. 25, 2017, both of which are hereby incorporated by reference in their entirety.

BACKGROUND OF THE INVENTION

Field of Invention

This disclosure relates to coated paperboard having good smoothness and printability at low coat weights.

Description of the Related Art

Paper and paperboard are used for many printing and packaging applications. Paperboard grades are heavier than paper grades, and are typically characterized as having a caliper (thickness) of at least 10 mils (0.010"; 254 μm) or 12 mils (0.012"; 305 μm); such calipers are also commonly called 10 point (10 pt) or 12 point (12 pt). It is often desirable for paperboard to have a surface well suited for printing, which may be characterized by various properties including smoothness, gloss, ink receptivity, and other measurements.

Commonly-owned U.S. Pat. No. 8,142,887 discloses a paperboard substrate with a basecoat including calcium carbonate and hyperplaty clay, with at most about 60 percent of the calcium carbonate having a particle size smaller than 2 microns, and with the hyperplaty clay having an average aspect ratio of at least about 40:1. The disclosed paperboard has good smoothness. However, to achieve superior print quality (e.g. Parker Print Surf below 2 microns), paperboard having been base coated is often given one or more additional coats. It would be advantageous to achieve superior print quality with only a single coat, preferably using a relatively low coat weight. It would also be advantageous to achieve superior print quality with a base coat that does not require hyperplaty clay in its formulation.

SUMMARY OF THE INVENTION

In the present work, certain inventive coatings are able to provide superior smoothness and printability with a single layer of coating applied at remarkably low coat weight compared with the typical total coat weight of double coating. Parker Print Surf smoothness values of 2.5 microns and lower are achieved with a single layer of the inventive coatings having coat weights of 6 lbs/3000 $ft^2$ (9.8 $g/m^2$) and higher. In other embodiments, certain inventive base coats are disclosed which may be used with various top coats to achieve superior smoothness and printability.

DETAILED DESCRIPTION OF THE INVENTION

Figure 1:
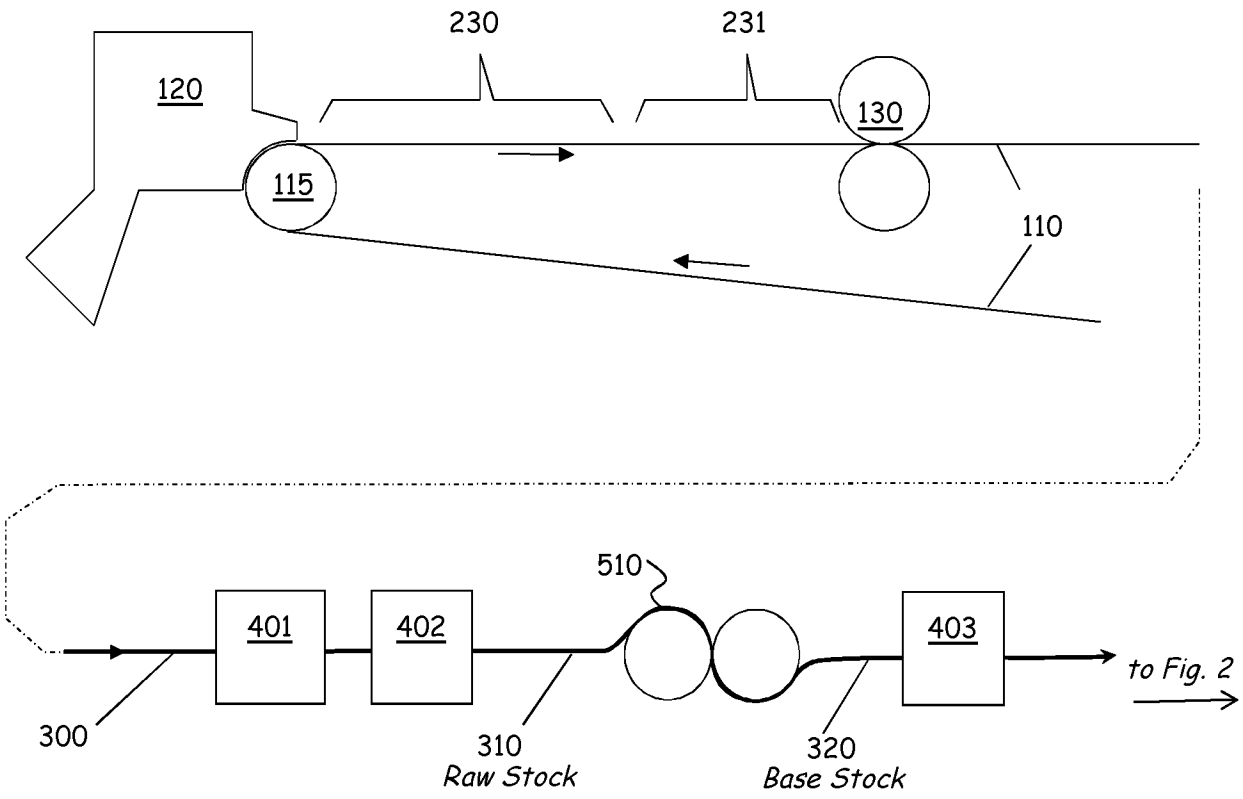
FIG. 1 illustrates a method for producing a base stock on a paperboard machine.
Figure 2:
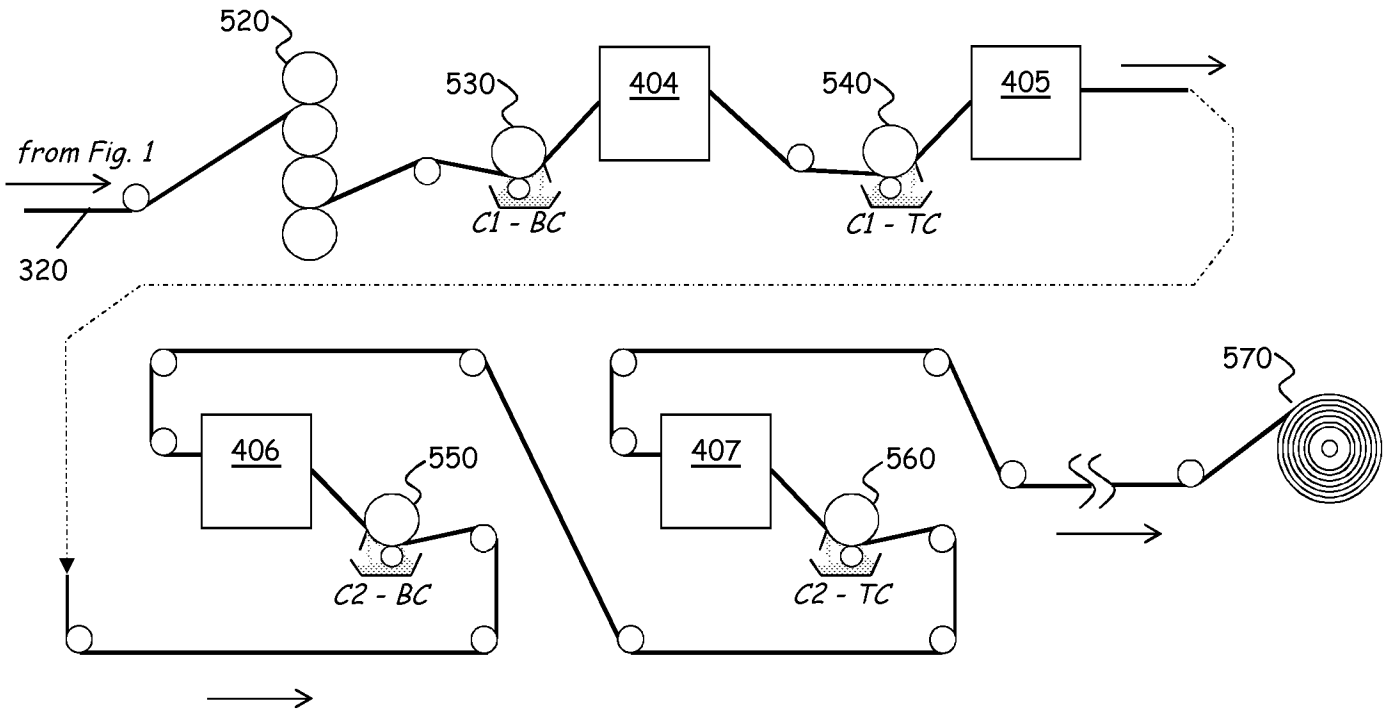
FIG. 2 illustrates a method for treating the base stock from FIG. 1 by applying coatings to both sides on a paperboard machine.

FIG. 1 and FIG. 2 illustrate an exemplary on-paper machine method for coating a paperboard web with one or more layers of aqueous coating. A forming wire 110 in the form of an endless belt passes over a breast roll 115 that rotates proximate to a headbox 120. The headbox provides a fiber slurry in water with a fairly low consistency (for example, about 0.5% solids) that passes onto the moving forming wire 110. During a first distance 230 water drains from the slurry and through the forming wire 110, forming a web 300 of wet fibers. The slurry during distance 130 may yet have a wet appearance as there is free water on its surface. At some point as drainage continues the free water may disappear from the surface, and over distance 231, water may continue to drain although the surface appears free from water.

Eventually the web is carried by a transfer felt or press felt through one or more pressing devices such as press rolls 130 that help to further dewatering the web, usually with the application of pressure, vacuum, and sometimes heat. After pressing, the still relatively wet web 300 is dried, for example using dryer or drying sections 401, 402 to produce a dry web ("raw stock") 310 which may then be run through a size press 510 that applies a surface sizing to produce a sized "base stock" 320 which may then be run through additional dryer sections 403 and (on FIG. 2) smoothing steps such as calendar 520.

The base stock 320 may then be run through one or more coaters. For example, coater 530 may apply a first coat ("BC") to a first side ("C1") of the web, and the first coat may be dried in one or more dryer sections 404. Coater 540 may apply a second coat ("TC") to the first side of the web, and the second coat may be dried in one or more dryer sections 405.

Figure 3:
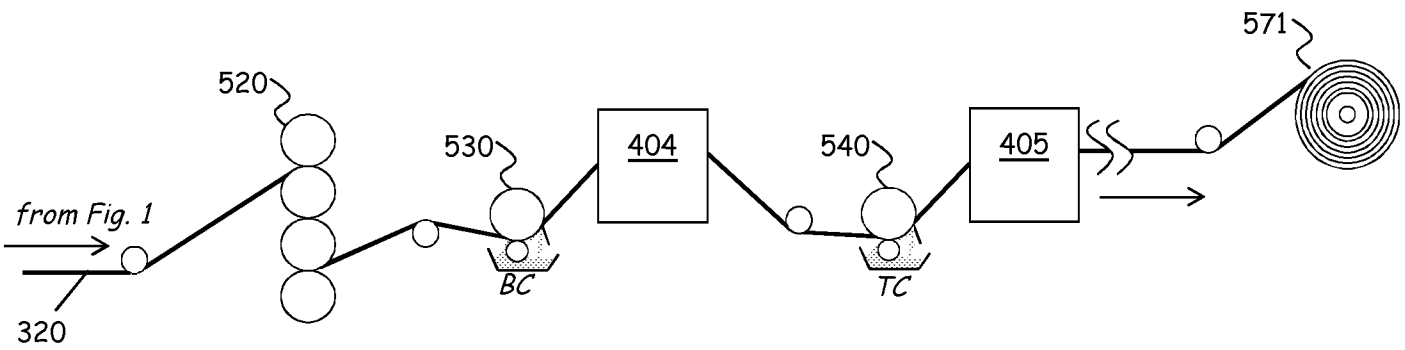
FIG. 3 illustrates a method for treating the base stock from FIG. 1 by applying coatings to one side on a paperboard machine.

If the web is to be coated on two sides, coater 550 may apply a first coat to the second side ("C2") of the web, and this coat may be dried in one or more dryer sections 406. Coater 560 may apply a second coat to the second side of the web, and this coat may be dried in one or more dryer sections 407. The order of coaters 540, 550 may be swapped, so that both sides C1 and C2 are first given a first coat, and then one side or both sides are given a second coat. In some instances, only one side will be coated as shown in FIG. 3, or only a first coat may be applied. In some instances, a third coat may be applied to one side.

Figure 4:
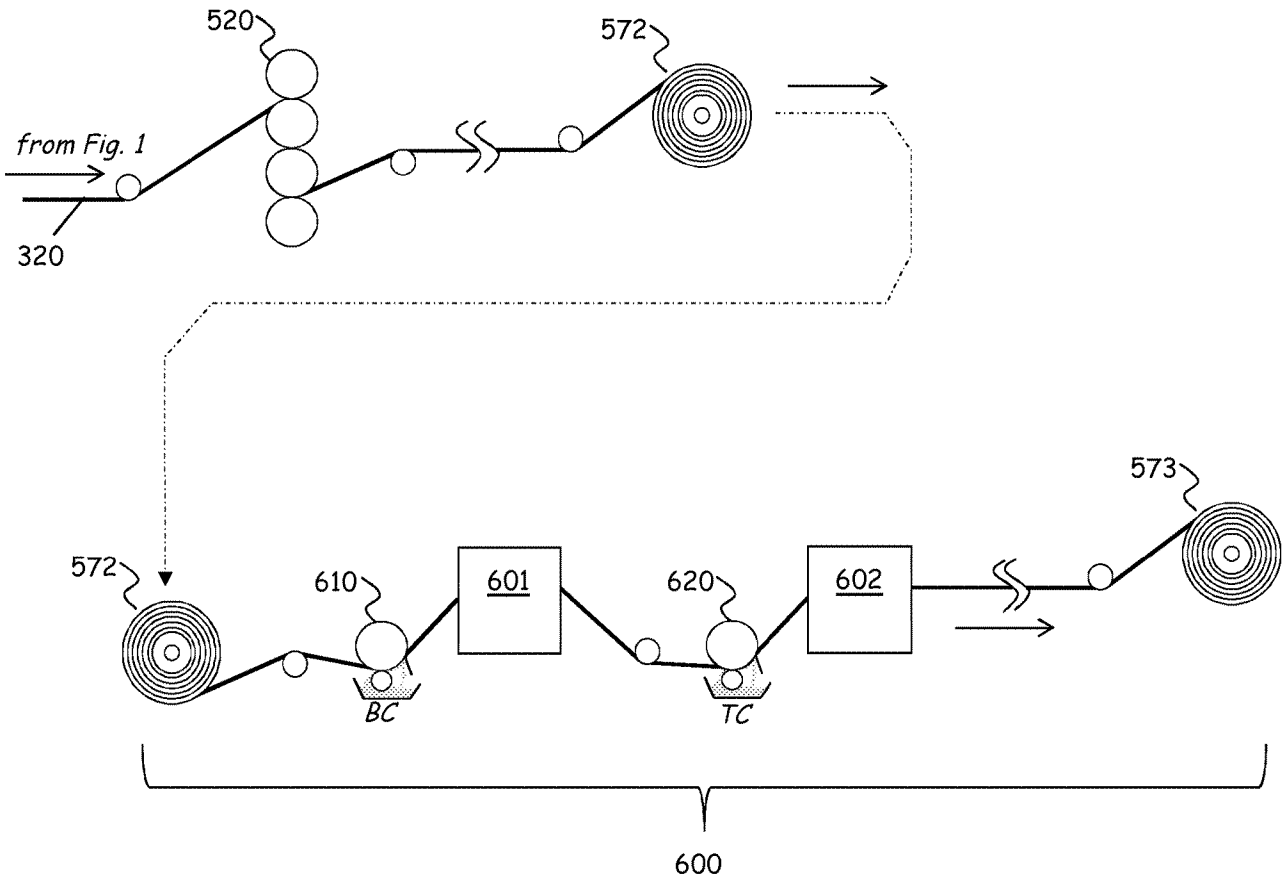
FIG. 4 illustrates a method for treating the base stock from FIG. 1 by applying coatings to one side on an off-machine coater.

Instead of applying coating by on-machine coaters as shown in FIGS. 2 and 3, coating may be applied by an off-machine coater as shown in FIG. 4. In such cases, the paperboard having been produced on the paper machine and wound onto reel 572 may then be transported (as a reel or as smaller rolls) to an off machine coater 600, where the paperboard is unwound from reel 572, given a first coating by coater 610, dried in dryer(s) 601, given an optional second coating by coater 620, dried in dryer(s) 602, optionally given further treatment (such as gloss calendaring) and then wound onto reel 573. An off machine coater could instead apply a single coat to one side of the paperboard, or could apply a single coat to each side, or could apply more than one coat to either or both sides. Alternately some coating may be done on the paper machine, with additional coating done on an off-machine coater.

Various types of coating devices may be used. The coaters illustrated in FIGS. 2-4 are devices where a coating is held in a pan, transferred by a roll to the lower surface of the web (which may be either the first side or the second side depending on the web path), and then the excess coating scraped off by a blade as the web wraps partially around a backing roll. However other coater types may be used instead, including but not limited to curtain coater, air knife coater, rod coater, film coater, short-dwell coater, spray coater, and metering film size press.

The particular materials used in the coatings may be selected according to the desired properties of the finished paperboard. For example, the coating(s) may provide desired printability, as indicated by various measurements including smoothness, gloss, ink hold out, etc.

Following the coaters, there may be additional equipment for further processing such as additional smoothening, for example gloss calendaring. Finally, the web is tightly wound onto a reel 570.

The general process of papermaking and coating is outlined at a high level in the preceding description and with FIGS. 1-4. Further discussion will now be directed toward properties that are associated with high quality printable paperboard. Coated board, whether bleached, unbleached or recycled, is conventionally made by applying two layers of coating to the board surface. This is required due to the high level of roughness of the board surface. The first coating, referred to as a basecoat, is typically made using a coarse pigment which is often coarse ground calcium carbonate (GCC). Its purpose is to fill in the roughness of the board surface. The second coating, referred to as the topcoat, is typically made from fine pigments, and its purpose is to make a smooth ink receptive surface for printed images. Some manufacturers use three coating layers to cover paperboard roughness. Because of the unsuitability of fine pigments for covering roughness and the unsuitability of coarse pigments for printing, this multilayer process is universal for producing paperboard with a quality printing surface.

In contrast, the current invention as described in PART I below is a method for producing a quality printing surface using only a single layer of coating. In another embodiment as described in PART II below, the current invention is a method for producing a quality printing surface using a specialized base coat over which a top coat may be applied.

Part I. Method Using a New Coating as a Single Coat

Two key performance parameters for coated board are smoothness and printability. There are a wide variety of methods for measuring both properties. Here, Parker Print-Surf (PPS) smoothness is used as the smoothness test, with 10 psi (68.9 kPa) pressure and a soft backing. For printability measurements, a Prufbau printability tester was used to apply a uniform layer of cyan ink. 15 μl of Prufbau cyan ink to the inking roller for each sample. The printing pressure was 1100 N, and the speed was 2.5 m/sec. Print gloss was measured using the standard TAPPI gloss method.

Paperboard samples were made using solid bleached sulphate (SBS) substrate with a caliper of 10.5 pt (0.0105"; 267 μm). The samples were coated on one side using a pilot blade coater with either one layer or two layers of coating. The pilot results are expected to be representative of results that might be achieved on a production paper machine or a production off-machine coater.

A series of coating formulations were applied to paperboard using a blade coater. The pigments had a wide range of densities, so the coatings were formulated based on volume percent. The inorganic pigments were:

Hydrocarb 60—A coarse GCC from Omya

Hydrocarb 90—A fine GCC from Omya

Barrisurf HX—A coarse hyper platy clay from Imerys

Low density organic pigments (LDOP) were also used. These were hollow sphere plastic pigments from Dow, but there are other pigments that fall into the category. The LDOP pigments tested here did not include pigments that substantially expand during drying. By non-expanding pigments is meant that the pigments do not expand more than 10% by volume during drying of the coating.

The non-expanding LDOP pigments used were:

Ropaque AF-500 EF—a low density pigment with a 0.4μ diameter

Ropaque OP-96—a low density pigment with a 0.6μ diameter

Ropaque AF-1055—a low density pigment with a 1.0μ diameter

Ropaque AF-1353—a low density pigment with a 1.3μ diameter

Ropaque TH-2000AF—a low density pigment with a 1.5μ diameter

The binder used in all coatings was Basanol X497AB, a styrene acrylate latex from BASF. The addition level of this latex binder was the same for all coatings, and was 26.4% based on total dry pigment volume. When calculating the amount of LDOP to be each in a formulation, it was assumed that the empty spaces within the LDOP pigments were filled with air. The experimental design was based on pigment blends and ratios, so in the following tables, only the pigment portion is presented. All pigments total 100% for each formulation.

Coating formulations A-P are shown in Table 1. In addition, a double coated sample was made using approximately 8 lb/3000 $ft^2$ (13.0 $g/m^2$) of coating A as a basecoat and 6 lb/3000 $ft^2$ (9.8 $g/m^2$) of coating B as a topcoat. The coatings were applied onto solid bleached sulfate paperboard which had an initial (uncoated) basis weight of 103 lb/3000 $ft^2$ (167 $g/m^2$) and a PPS value of 7.7μ. Coatings were applied at 800 fpm (4.1 m/sec) using a bent blade configuration. For each coating multiple coat weights were applied to the board. Other than double-coated samples used as references, the samples were single-coated with range of coat weights from approximately 6-9 lb/3000 $ft^2$ (9.8-14.6 $g/m^2$) being run for each sample.

Table 2 shows ink gloss data for calendered single-coated samples with coat weights closest to 7 lb/3000 $ft^2$ (11.4 $g/m^2$). Ink gloss is reported as a percent of the reference standard. Measurements were made using a Glossmeter Model T480A from Technidyne Corporation.

Table 3 shows PPS smoothness for single-coated samples after they were hot soft roll calendered at 300 fpm (1.5 m/sec), 225° F. (107° C.) and 125 pli (21900 N/m). PPS Smoothness was measured using a Technidyne Profile Plus instrument.

Example 1

In this Example, four coating formulations were selected from the list shown in Table 1. A typical coarse carbonate basecoat (formulation A) and a typical clay/carbonate topcoat (formulation B) were applied (to separate samples) as single coats. An improved basecoat (formulation C) based on hyper platy clay, in accordance with U.S. Pat. No. 8,142,887, was evaluated, and also an improved coating (formulation G) containing hyper platy clay and a LDOP.

Figure 5:
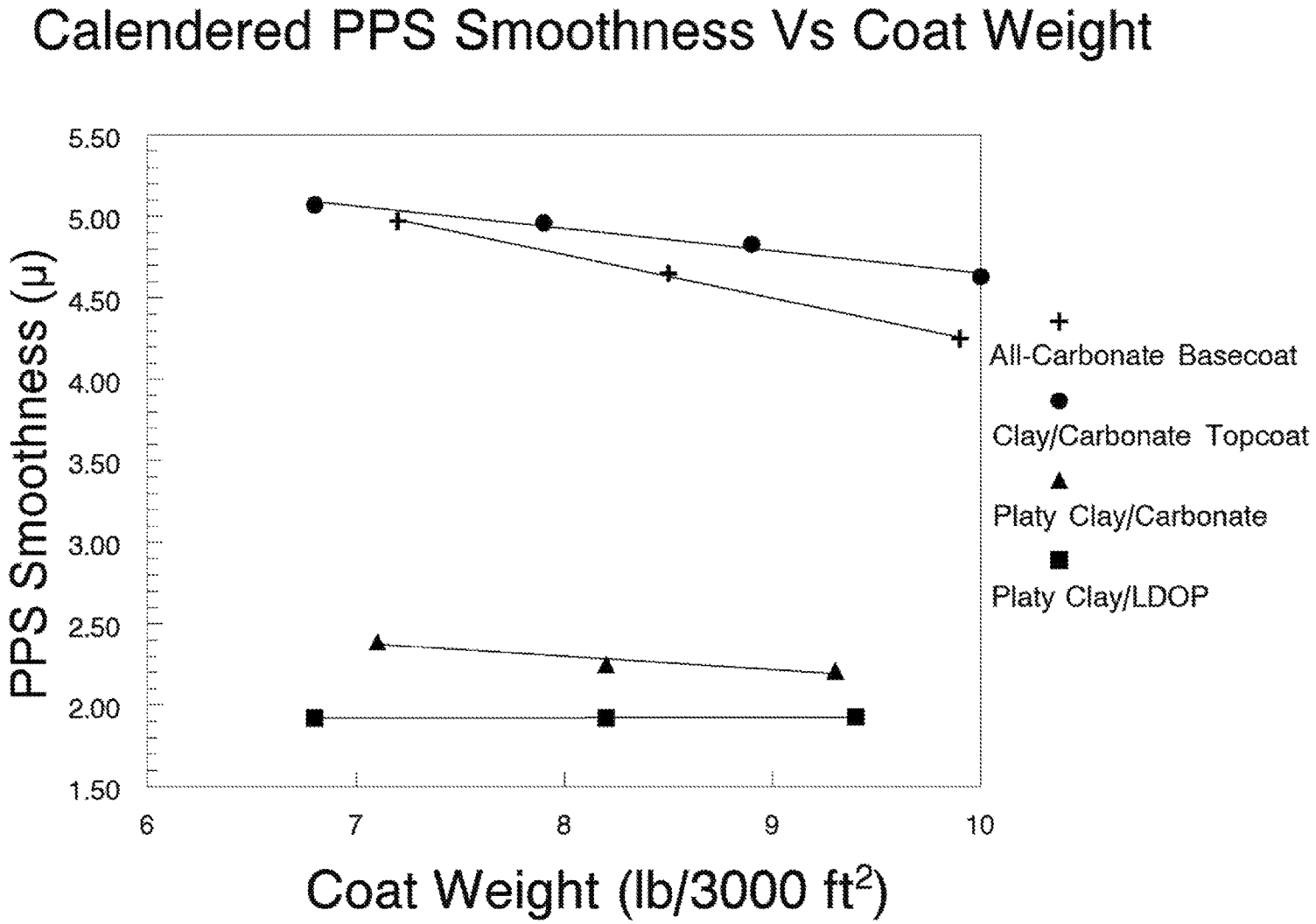
FIG. 5 illustrates the effect of coat weight on Parker PrintSurf (PPS) smoothness for single-coated samples.

FIG. 5 shows PPS smoothness results for single-coated samples after calendering. A typical basecoat (A) or topcoat (B) formulation (upper portion of the graph) do not sufficiently reduce the surface roughness. However, a coating (C) of hyperplaty clay with coarse carbonate greatly reduced the roughness (lower portion of the graph). Additional improvement was realized with a coating (G) using a LDOP as the co-pigment instead of carbonate.

Figure 6:
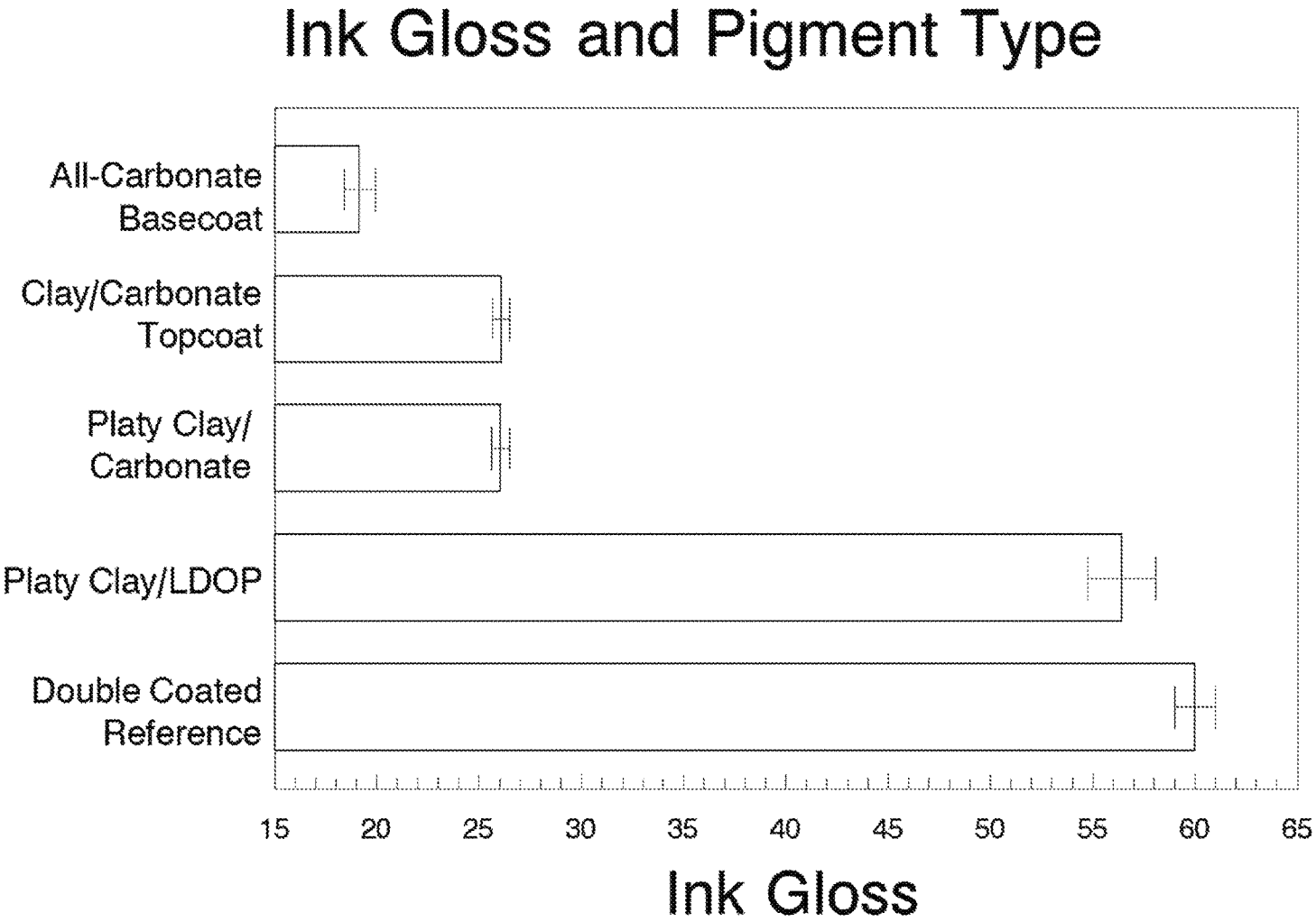
FIG. 6 illustrates the effect of various pigments on ink gloss for single-coated samples.

FIG. 6 shows that printability (of the single-coated samples after calendering) as measured by ink gloss, is poor (upper three graph bars) for the all-carbonate basecoat (A), clay/carbonate topcoat (B), and improved platy clay/carbonate basecoat formulation (C) compared to the double coated reference (bottom graph bar). Only the combination of platy clay and LDOP (G) gives single-coated ink gloss similar to the double coated reference.

Example 2

Figure 7:
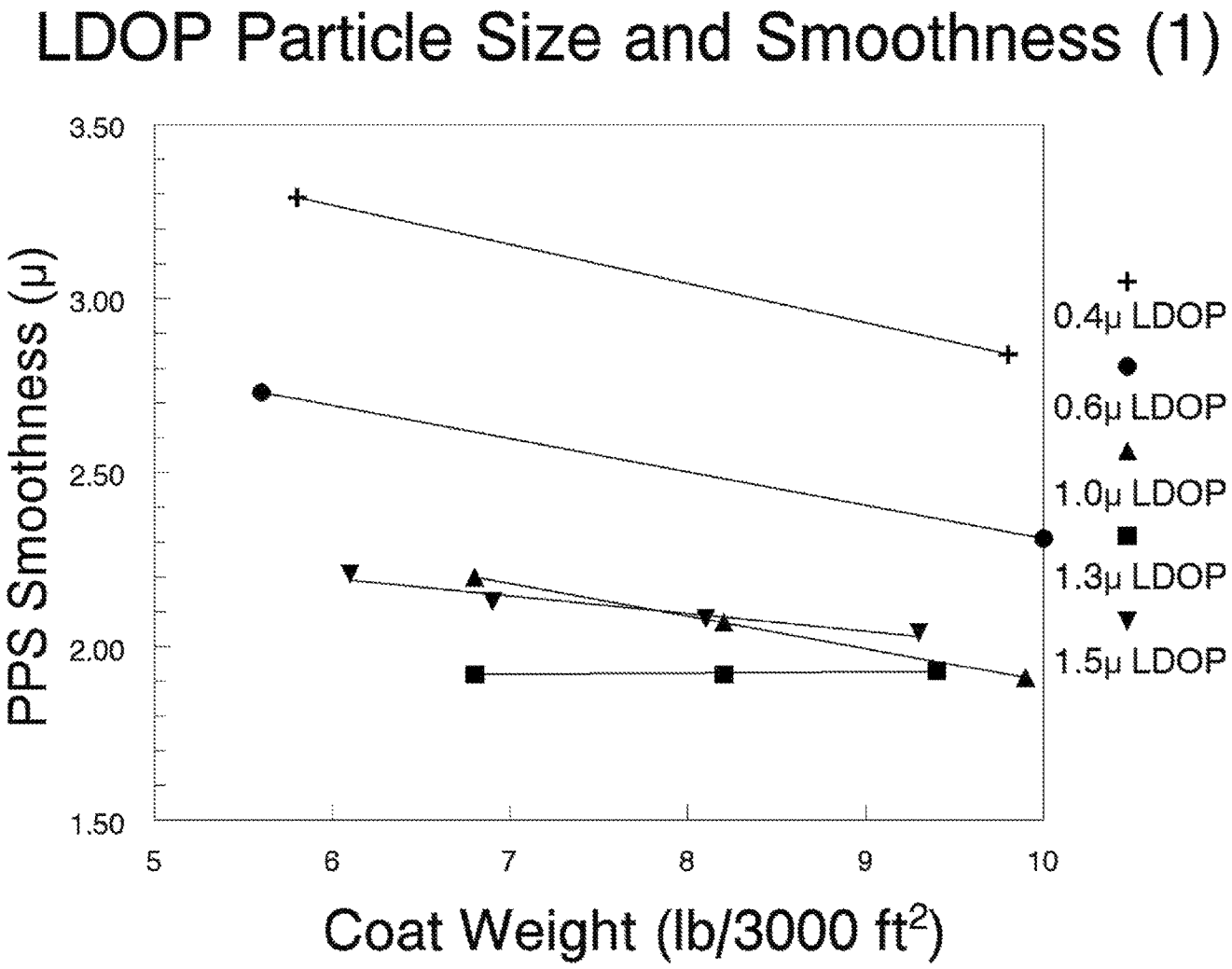
FIG. 7 illustrates the effect of coat weight and LDOP particle size on PPS smoothness for single-coated samples.
Figure 8:
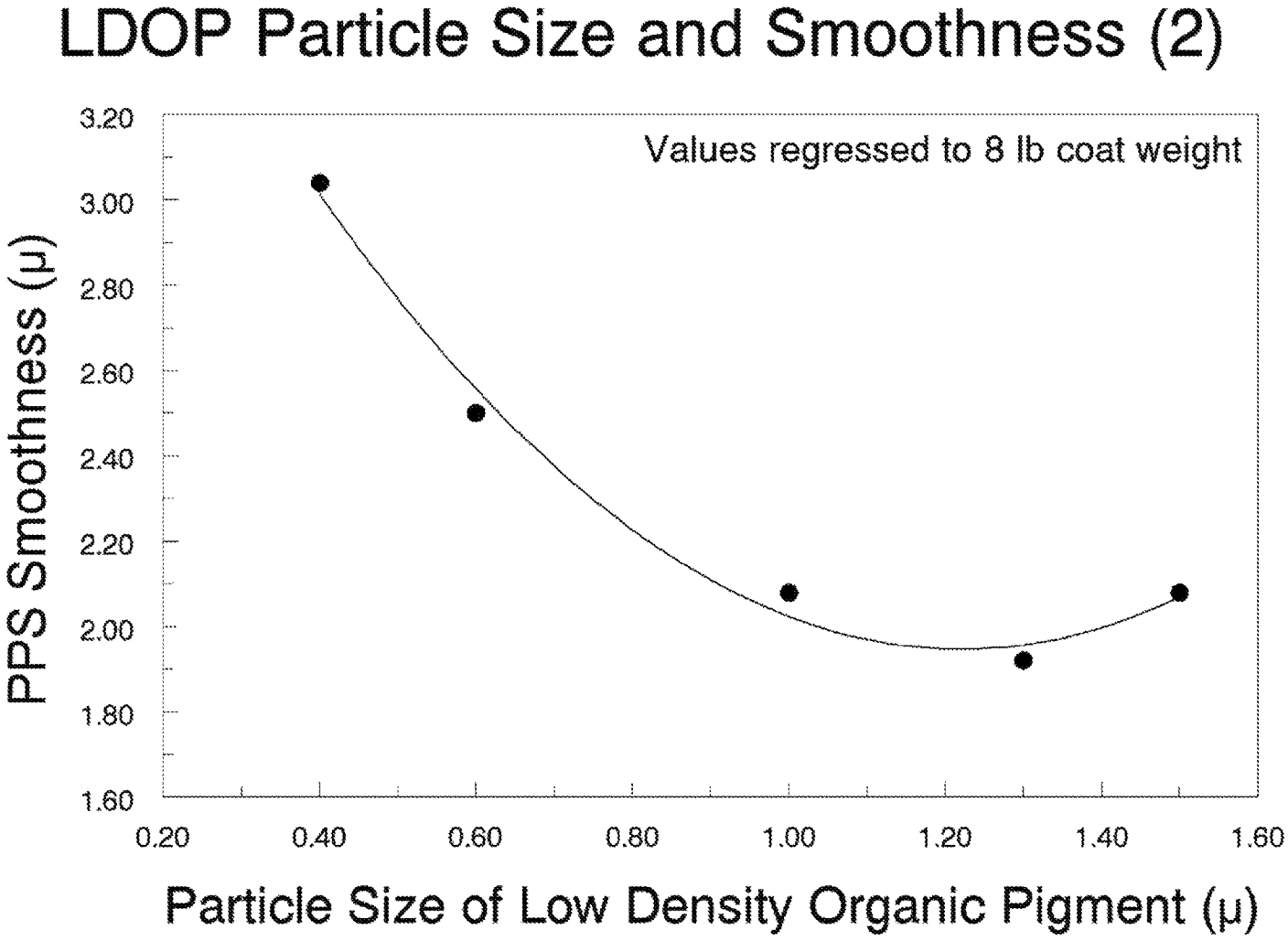
FIG. 8 illustrates the effect of LDOP particle size on PPS smoothness for single-coated samples at 8 lbs (13.0 $g/m^2$) coat weight.
Figure 9:
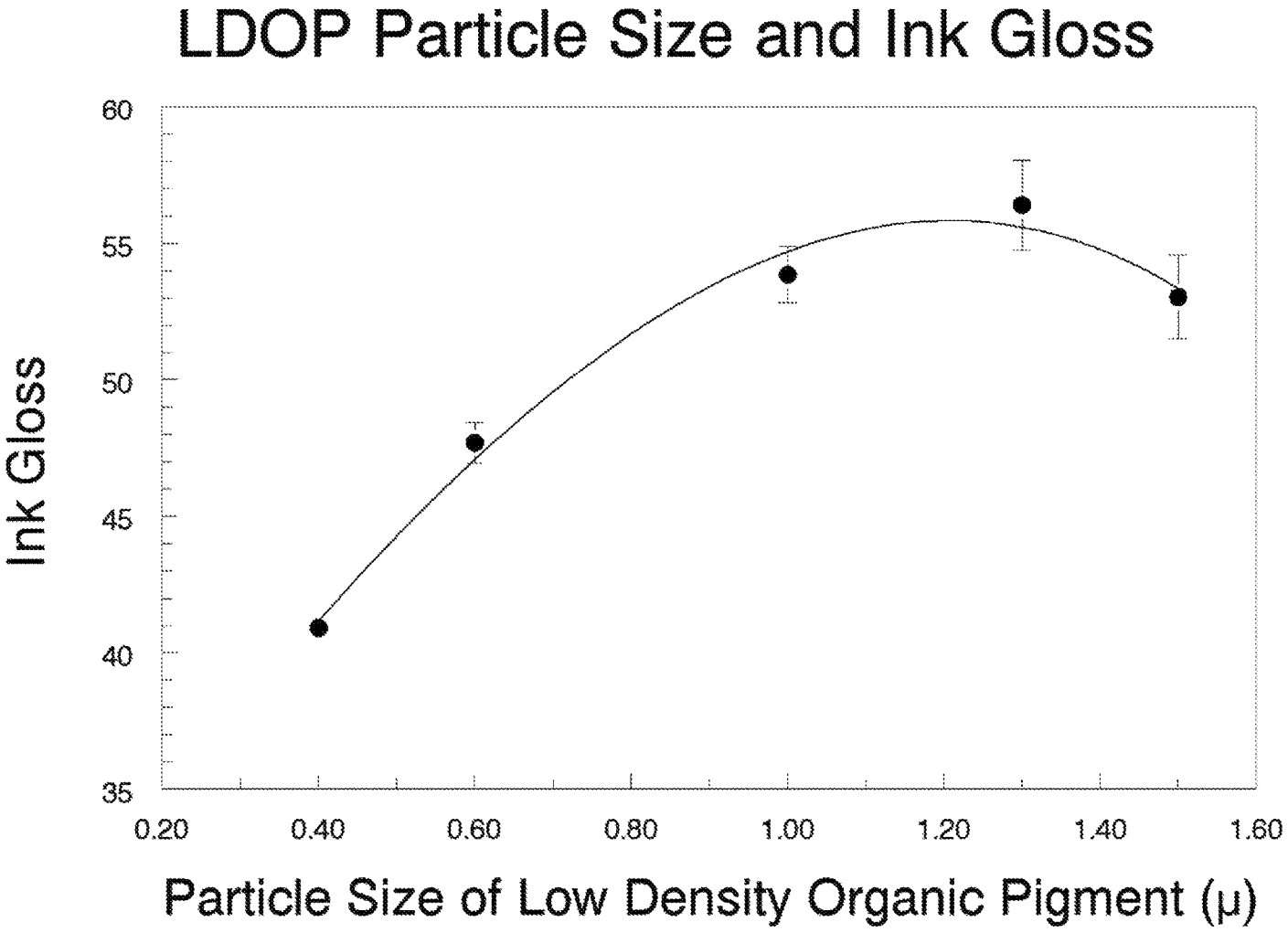
FIG. 9 illustrates the effect of LDOP particle size on ink gloss for single-coated samples.

This experiment explored the effect (single-coated samples after calendering) on smoothness and ink receptivity of LDOP particle size over a diameter range from 0.4 to 1.5μ (coatings D-H). All coatings were a 50/50 blend of clay and LDOP. FIG. 7 shows smoothness results that indicate LDOP particles at 0.4 u and 0.6 u (upper two graph lines) do not improve smoothness relative to the clay/carbonate blend shown in Example 1. However, all sizes 1.0μ and greater (lower three graph lines) improved smoothness. Using regression lines from FIG. 7, the smoothness values were determined for each graph line at 8 lb (13.0 $g/m^2$) coat weight, and these values were graphed on FIG. 8 where the effect of LDOP particle size can be more clearly seen. The data show a minimum PPS Smoothness (best smoothness) for a LDOP diameter of 1.3μ. FIG. 9 correspondingly shows that ink gloss shows a similar result with the three largest diameters of LDOP giving the highest ink gloss.

Example 3

Figure 10:
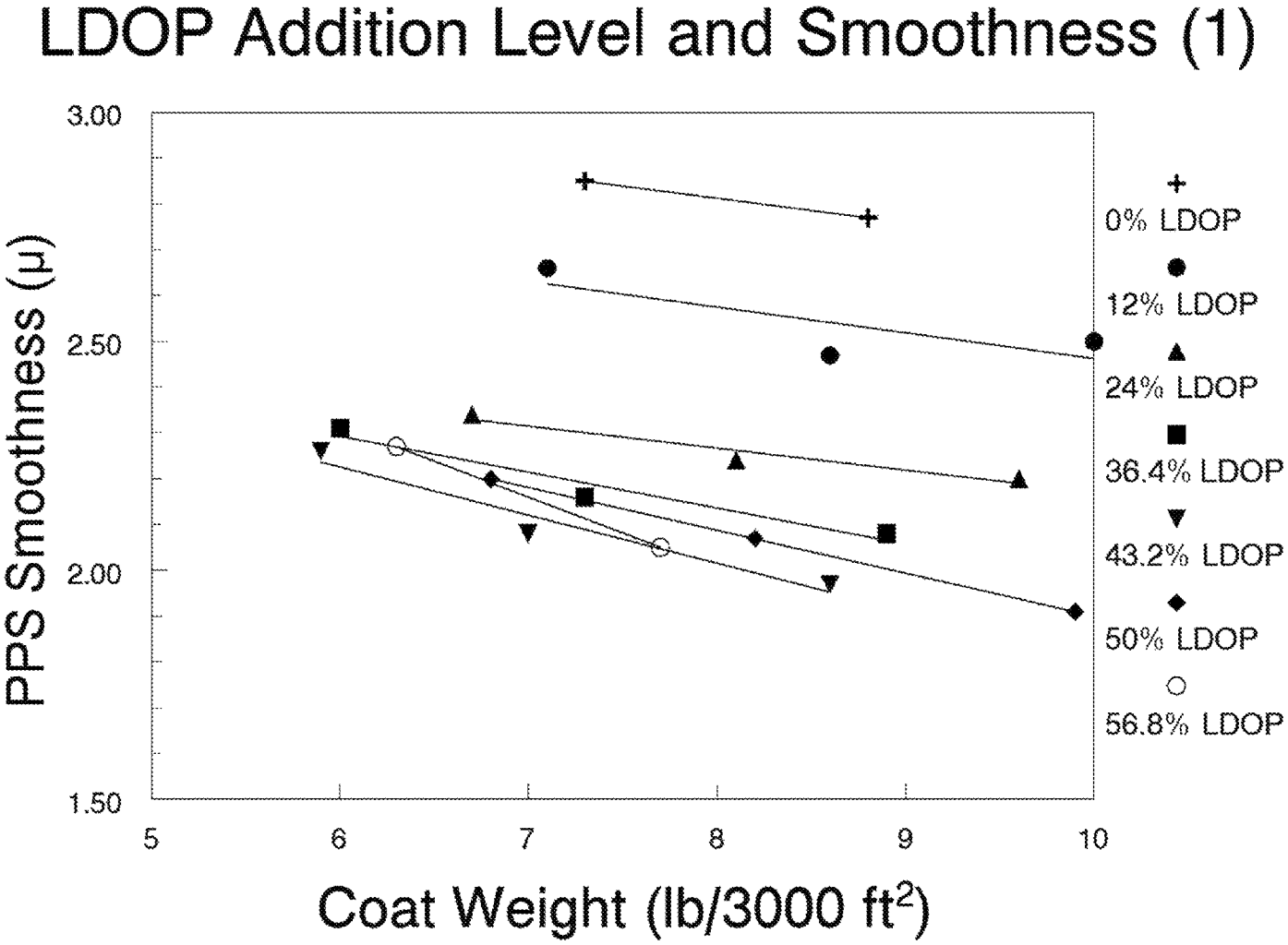
FIG. 10 illustrates the effect of coat weight and LDOP concentration on PPS smoothness for single-coated samples.

This experiment explored the effect of LDOP addition to coating containing hyperplaty clay. The control formulation had 100% platy clay as the pigment (I), that is, 0% LDOP. The LDOP level was varied between 12% and 57% by volume (Coatings F, I-N). FIG. 10 shows that PPS smoothness (of single-coated samples after calendaring) improves (roughness decreases) as the addition level increases to about 43%, then the PPS smoothness levels off. This is more clearly evident in FIG. 11 which is graphs the smoothness values of FIG. 10 regressed to an 8 lb (13.0 $g/m^2$) coat weight.

Figure 11:
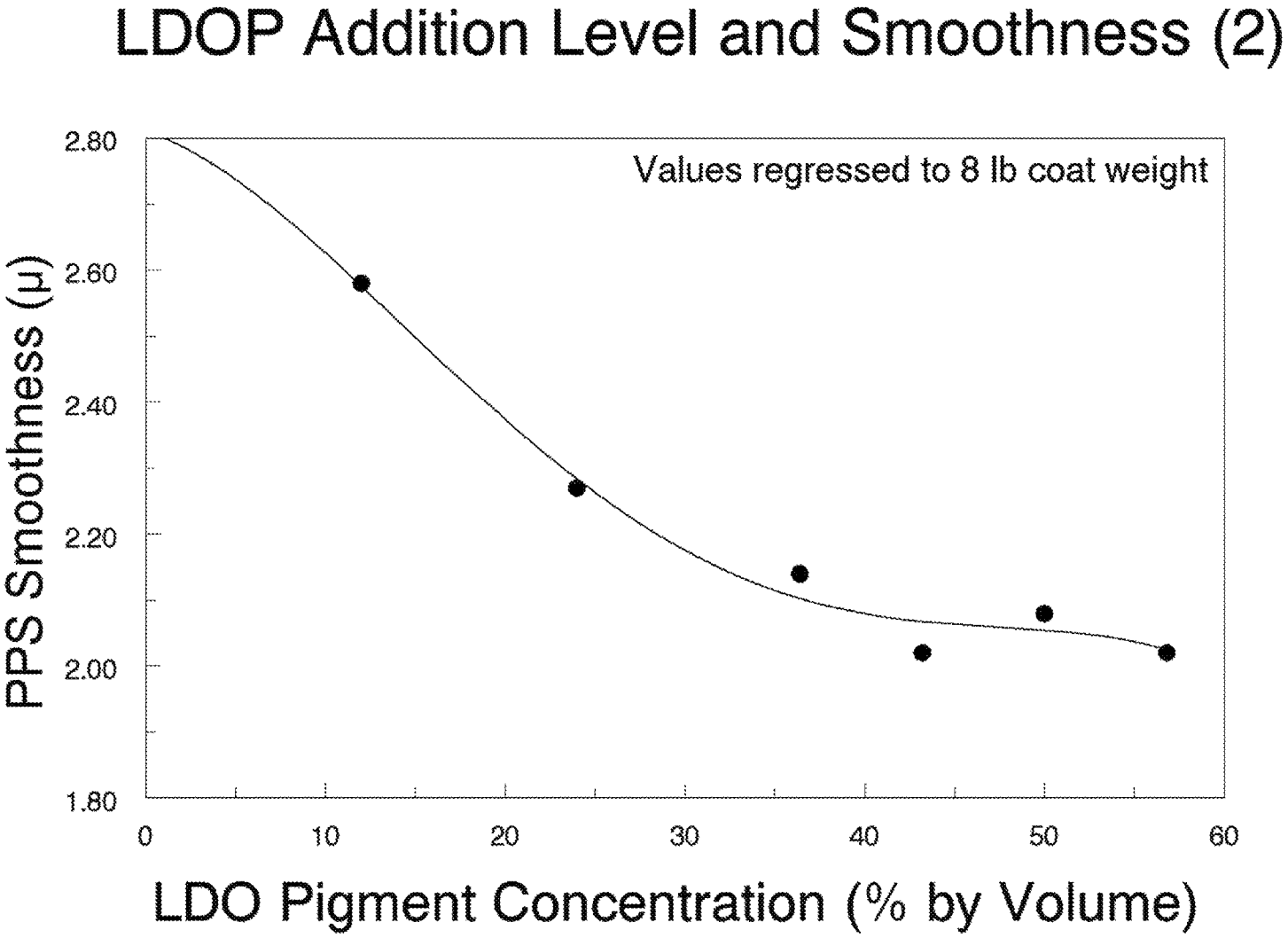
FIG. 11 illustrates the effect of LDOP concentration on PPS smoothness for single-coated samples at 8 lbs coat weight.
Figure 12:
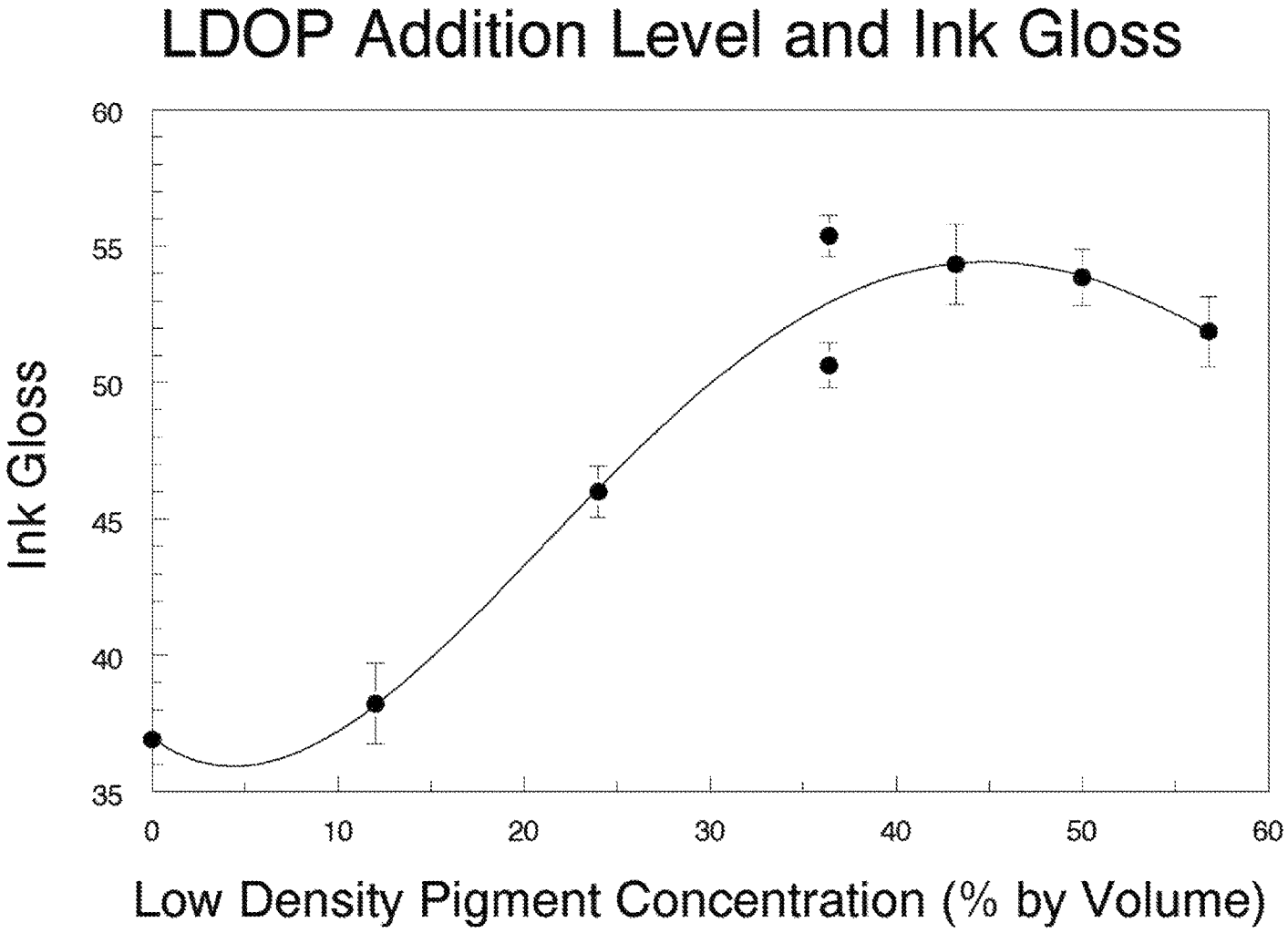
FIG. 12 illustrates the effect of LDOP concentration on ink gloss for single-coated samples.

FIG. 12 shows corresponding ink gloss results (on single-coated samples after calendaring) for the same formulations as in FIG. 11. Ink gloss gradually increases as the LDOP level increases until about 36%, but further addition of LDOP does not increase ink gloss.

Example 4

Figure 13:
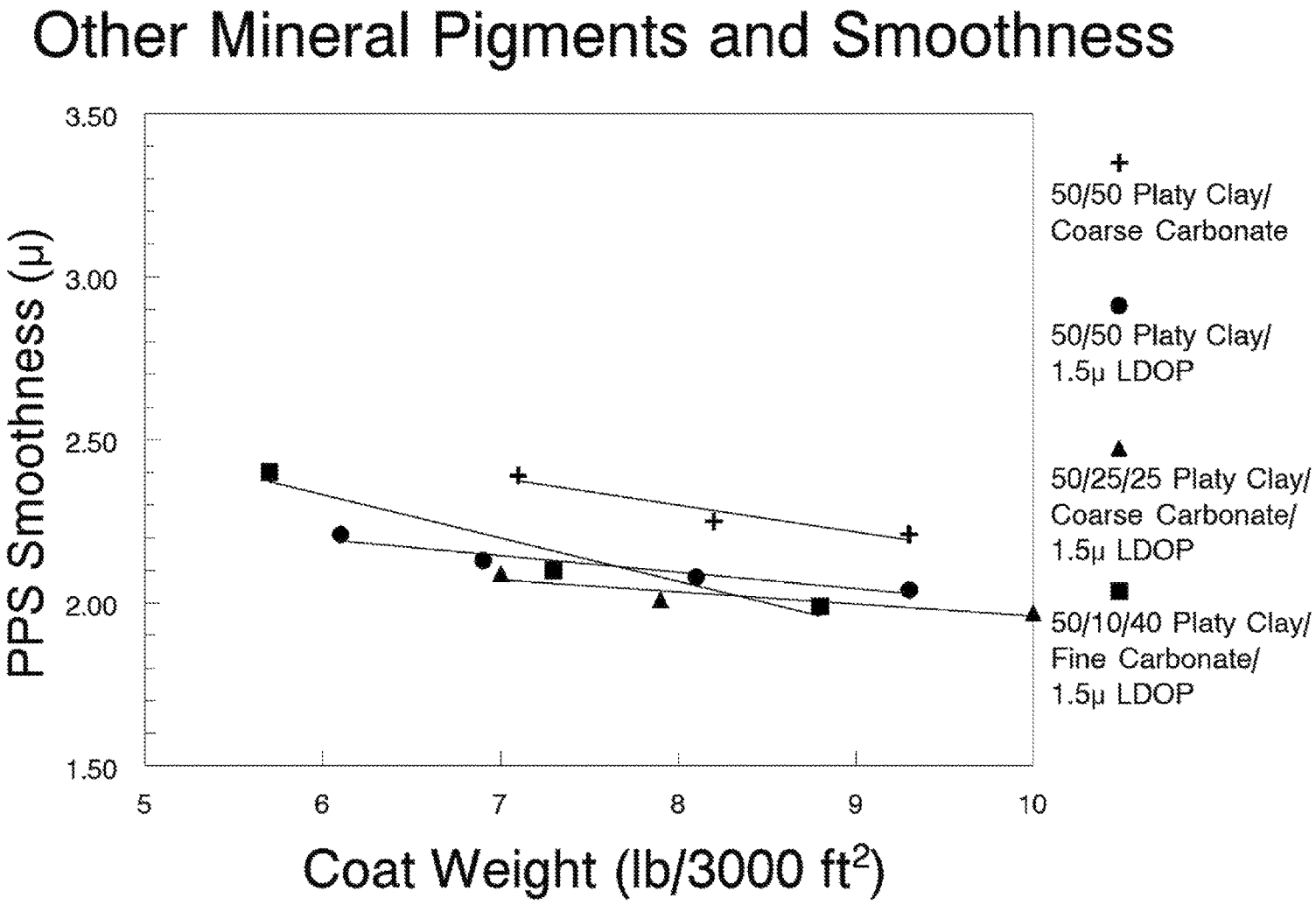
FIG. 13 illustrates the effect of coat weight and various mineral pigments on PPS smoothness for single-coated samples.

FIG. 13 shows the effect on smoothness (on single-coated samples after calendaring) of including other pigments with a formulation including 50 parts (volume) platy clay. Compared with a formulation (upper line) containing the other 50 parts as coarse GCC, addition of 1.5 LDOP improved smoothness (PPS decreased) as seen in the bottom three lines. There did not appear to be much difference (bottom three lines) between using 50 parts LDOP, 25 parts coarse GCC and 25 parts LDOP, or 10 parts fine GCC with 40 parts LDOP.

Figure 14:
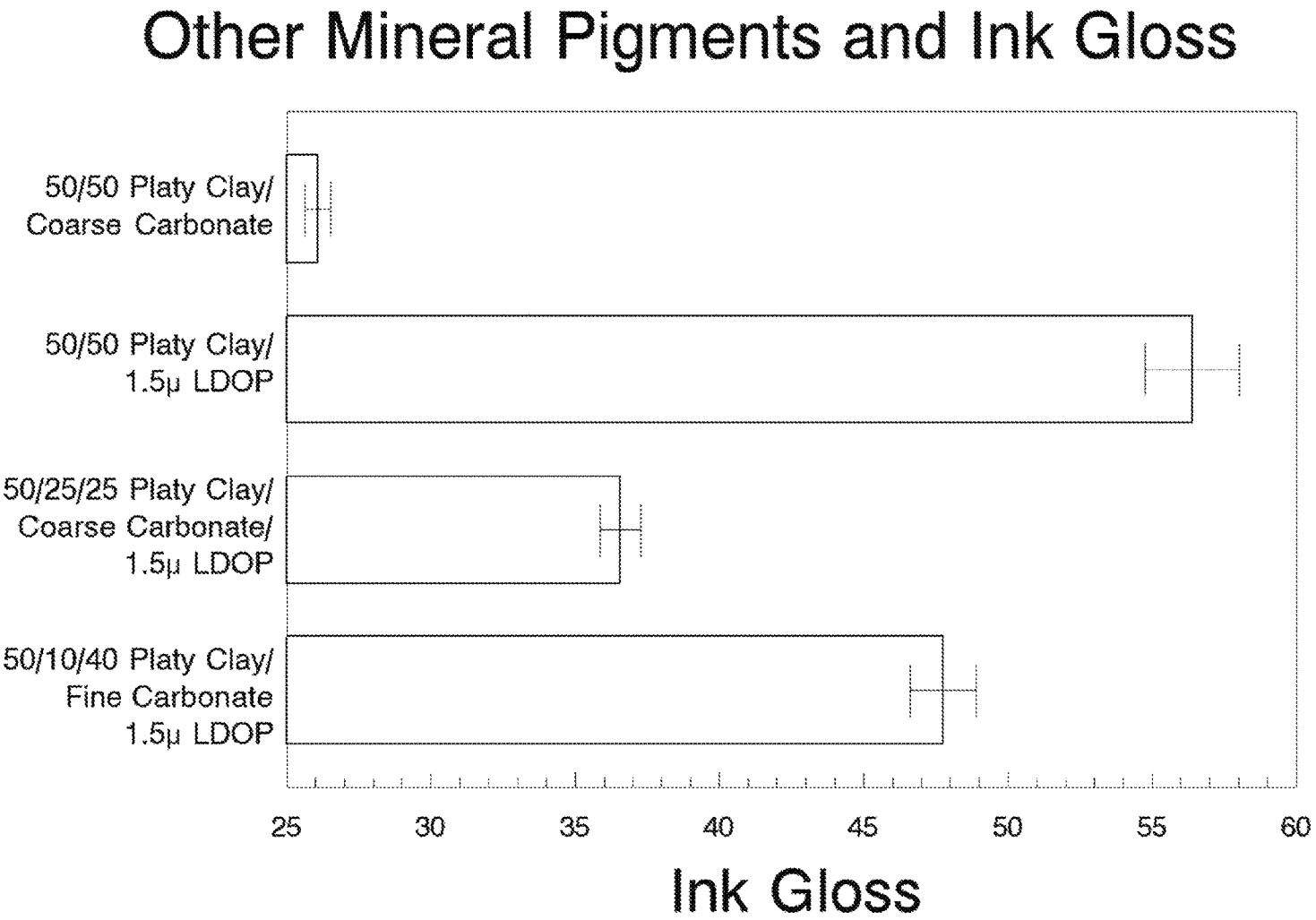
FIG. 14 illustrates the effect of mineral pigments on ink gloss for single-coated samples.

FIG. 14 likewise shows that compared with the reference (upper bar), the best improvements in printability (as reflected by higher ink gloss on single-coated samples after calendering) were achieved with 50 parts LDOP replacing the coarse GCC (second bar). However, significant improvements in ink gloss (lower two bars) can still be obtained when other pigments (GCC) replace some of the LDOP.

Example 5

Figure 15:
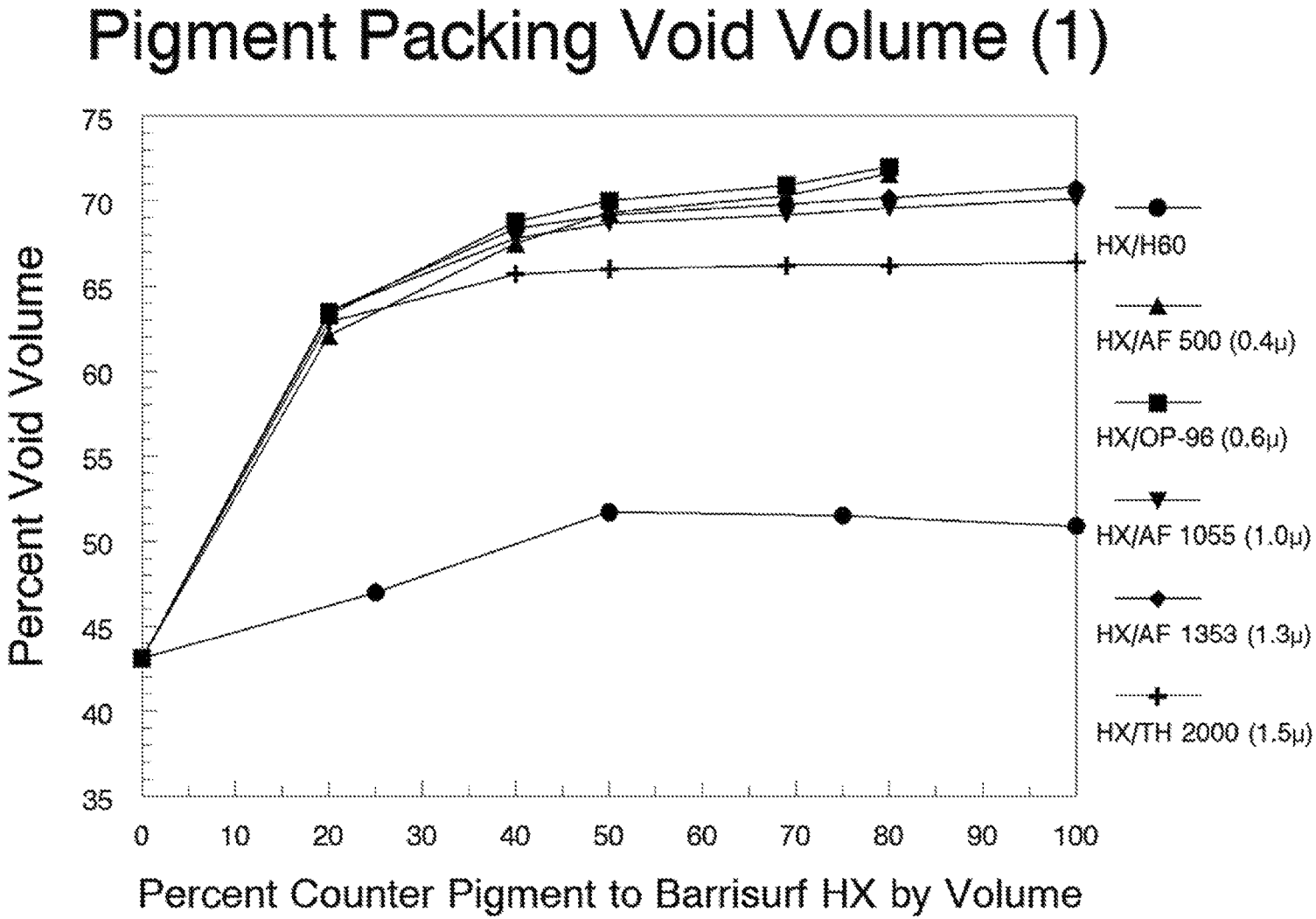
FIG. 15 illustrates the effect of LDOP and their percent on pigment packing void volume.

Experiments were performed to measure the pigment packing behaviour of pigment blends containing LDOP. Because of the density differences between LDOP and inorganic pigments, a method other than sedimentation had to be used. A method was devised using the absorption of mineral oil into layers of pigment blends to measure the void volume within packed pigments. All pigment blends were formulated based on volume. Because the films needed to maintain their integrity when oil was applied, a controlled volume of latex binder was added to each blend. The method was as follows. Pigment blends were applied to Mylar film using a Byrd bar with a 10 mil gap. Each film was air dried, then placed in an oven at 160° F. (71° C.) for 20 minutes. A die cutter was used to cut a 3"×6" (7.6 cm×15.2 cm) area from both the coated and uncoated portion of the Mylar. These coupons were weighed to determine the weight of coating applied. The coated coupon was then saturated with mineral oil, then the excess was wiped away. The oil-saturated coupon was then weighed to determine the amount of oil picked up. The void volume can be calculated using the formulation, the weights, the densities of the components and the density of the oil. The volume of the binder was added to give the final void volume value. Pigment blends were initially made with 8% binder added. The coatings comprised of LDOP without any other pigment crazed and were not testable. The binder level was raised to 20% for these coatings and the coatings with LDOP of 1.0μ diameter or greater were testable. However, coatings with LDOP less than 1μ in diameter were still not testable. These two formulations were not tested. Table 4 contains the formulations and the results. FIG. 15 shows the effects of the LDOP level when blended with a hyperplaty clay. A curve "HX/H60" denoted by the circle symbols for blends of clay with coarse ground calcium carbonate is given as a reference (as shown in U.S. Pat. No. 8,142,887). For all diameters of LDOP, the void volume values increase as the addition level of LDOP increases. This demonstrates that LDOP give void volumes greater than those achieved in the U.S. Pat. No. 8,142,887.

Example 6

Figure 16:
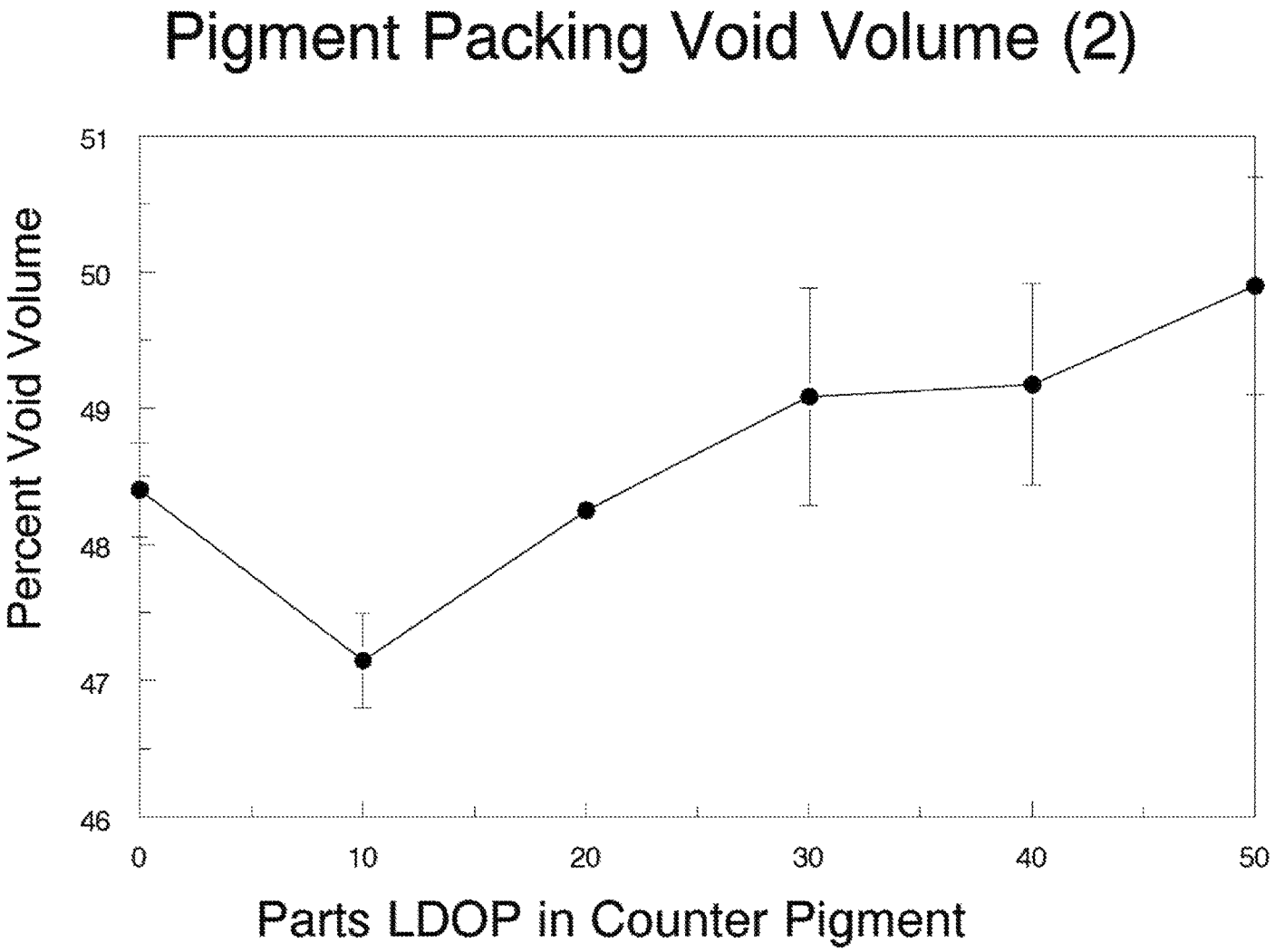
FIG. 16 shows the effect on percent void volume of blending LDOP with a mineral pigment and a hyperplaty clay.

Table 5 has data for pigments blends containing both coarse GCC and LDOP with hyperplaty clay. FIG. 16 shows the effect of blending Ropaque 1353 LDOP with Hydrocarb 60 as the counter pigment to Barrisurf HX. The Barrisurf HX volume content was held constant at 50%, and the ratio of 1353 and Hydrocarb 60 was varied. The results show that blends containing HX, GCC and LDOP can give equal or better void volume compared to clay carbonate blends (at 0 parts LDOP in FIG. 16, and as discussed in U.S. Pat. No. 8,142,887).

In summary, the results of PART I show that single-coated paperboard with good smoothness and printability is achieved by a single application of the inventive coating at weights of 6 lb/3000 $ft^2$ (9.8 $g/m^2$) or more, providing Parker PrintSurf values of 2.5μ or less and with printability similar to a conventional double-coated product typically having greater total coat weight.

Part II. Method Using a New Coating as a Base Coat

Paperboard samples were made using solid bleached sulphate (SBS) substrate with a caliper of 10.5 pt (0.0105"; 267 μm). The samples were coated on one side using a pilot blade coater to apply a base coat, followed by a top coat. The pilot results are expected to be representative of results that might be achieved on a production paper machine or a production off-machine coater.

A series of coating formulations were applied to paperboard using a blade coater. The pigments had a wide range of densities, so the coatings were formulated based on volume percent. The inorganic pigments were:

- Hydrocarb 60—A coarse GCC from Omya, previously mentioned
- Hydrocarb 90—A fine GCC from Omya, previously mentioned
- Kaofine 91—A fine clay from Thiele
- XP6170—A coarse platy clay from Imerys A low density organic pigment (LDOP) was used in the basecoat only. One LDOP was used, which does not expand substantially during drying. There are other LDOP pigments that fall into the "non-expanding" category. By non-expanding pigments is meant that the pigment does not expand more than 10% by volume during drying of the coating.

Figure 17:
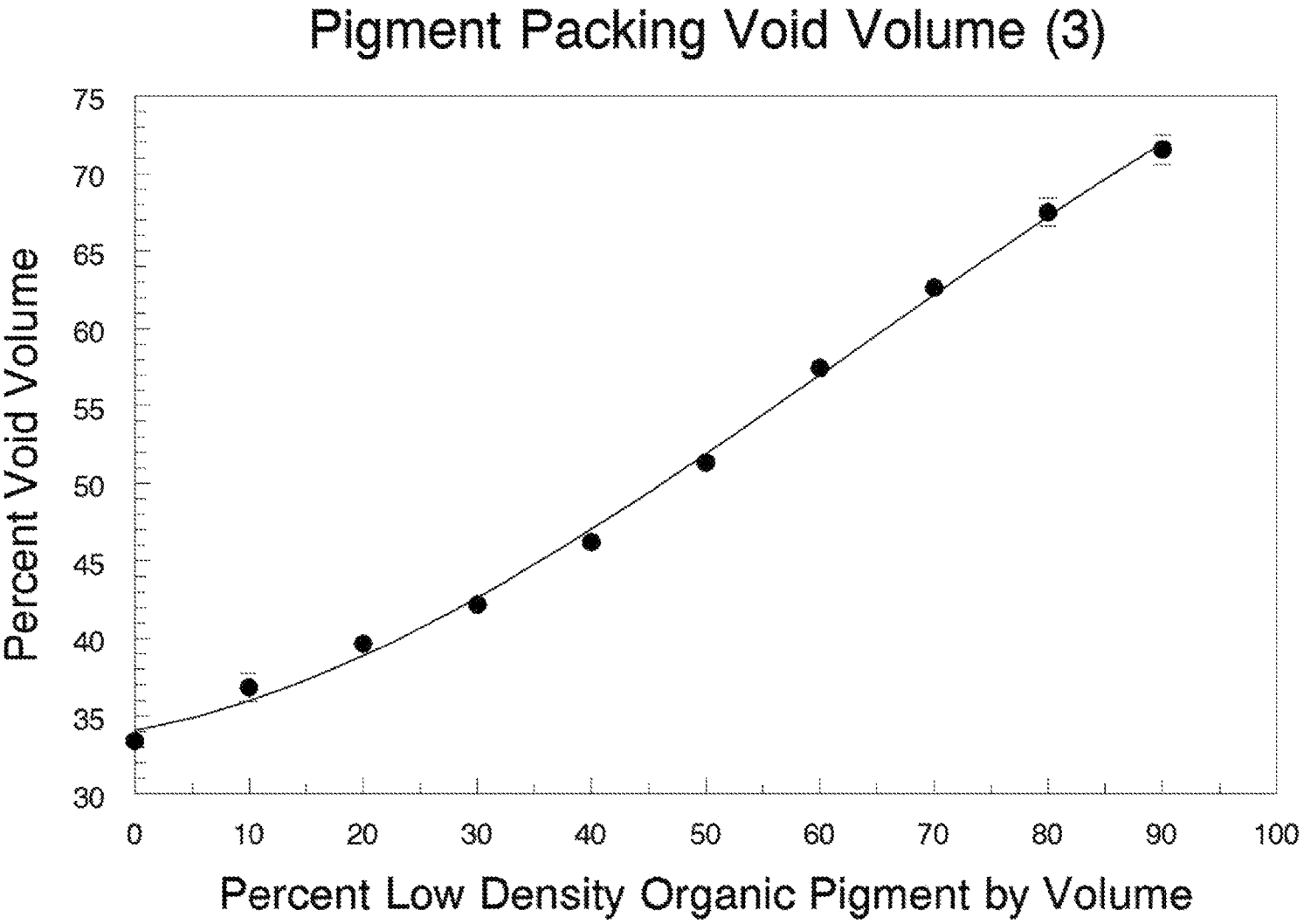
FIG. 17 shows the effect on percent void volume of blending LDOP with a mineral pigment.

The non-expanding LDOP pigment used was:

- Ropaque AF-1353—a low density pigment with a 1.3μ diameter from Dow, previously mentioned FIG. 17 shows a graph of pigment packing void volume for mixtures of the Ropaque AF-1353 LDOP pigment with Hydrocarb 60, a coarse ground calcium carbonate (GCC) used in the base coat formulations. The method described above was used, with absorption of mineral oil into layers of pigment blends to measure the void volume within packed pigments. The pigment packing void volume was about 33% with no LDOP, and rose steadily with increased amounts of LDOP. The increase in pigment packing volume was approximately linear between 30 and 90% LDOP by volume.

The binders used were:

- Ropaque AF-1353—a 1.3μ hollow synthetic pigment from Dow
- Rhoplex P-308—a latex from Dow
- Polyco 2160—a latex from Dow
- Resyn 1103—a latex from Celanese
- Selvol 203 S—a low molecular weight polyvinyl alcohol from Sekisui The binder levels (based on 100 parts of pigment) were about 18-21 parts for the various basecoat formulations, and about 14 parts for the topcoat formulation.

When calculating the amount of LDOP to be each in a formulation, it was assumed that the empty spaces within the LDOP pigments were filled with air. The experimental design was based on pigment blends and ratios, so in the following tables, only the pigment portion is presented. All pigments total 100% for each formulation.

Base coat formulations Q through T are shown in Table 6, which include a "standard" formulation Q (no LDOP), a 25% (volume) LDOP formulation R, a 41% (volume) LDOP formulation S, and a "platy-clay" formulation T (no LDOP).

Table 7 gives the ingredients for a single formulation used as a top coat as will be explained below.

The amount (weight) of LDOP to give a desired volume percent in the base coating is determined as follows. Although the density of calcium carbonate varies slightly due to impurities, a density value of 2.6 g/cc was used here for the Hydrocarb 60. The Ropaque 1353 LDOP, as specified by the manufacturer, has a void volume of 53% giving it an equivalent density of 0.484 g/cc. Assuming we want 25% by volume of LDOP, our calculations will be as follows:

75 cc×2.6 g/cc=195 g Hydrocarb 60 calcium carbonate 25 cc×0.484 g/cc=12.1 g Ropaque 1353 LDOP 207.1 g Total weight Thus to achieve 25% by volume of LDOP, divide 12.1 by 207.1 to arrive at 0.058, that is, 5.8% LDOP by weight which will achieve 25% LDOP by volume.

Assuming we want 50% by volume of LDOP, our calculations will be as follows:

50 cc×2.6 g/cc=130 g Hydrocarb 60 calcium carbonate 50 cc×0.484 g/cc=24.2 g Ropaque 1353 LDOP 154.2 g Total weight Thus to achieve 50% by volume of LDOP, divide 24.2 by 154.2 to arrive at 0.157, that is, 15.7% LDOP by weight will achieve 50% LDOP by volume.

On the other hand, the percent volume of LDOP associated with a particular weight of LDOP is determined as follows. Assuming twice as much (by weight) of LDOP would be used as in the first example (i.e., 11.6% by weight instead of 5.8% by weight) yields the following example (now assuming 100 g total=11.6 g LDOP and 88.4 g calcium carbonate):

11.6 g of LDOP divided by its density 0.484 g/cc=24.0 cc volume of LDOP 88.4 g of carbonate divided by its density 2.6 g/cc=34 cc volume of calcium carbonate 24 cc of LDOP divided by (24+34 cc total)= 0.414=41.4% LDOP by volume The base coat formulations were applied onto solid bleached sulfate paperboard which had an initial (uncoated) basis weight of 103 lb/3000 $ft^2$ (167 $g/m^2$). The uncoated paperboard has a PPS smoothness of 7.7μ and a Sheffield smoothness of 200. The base coatings were applied at 1500 fpm (7.6 m/sec) using a bent blade configuration. For each formulation, a single base coat was applied, with the basecoat weight ranging from 5 to 10 lb/3000 $ft^2$ (8.1 to 16.2 $g/m^2$). After drying, the samples in uncalendared condition were tested for Parker PrintSurf (PPS) smoothness and Sheffield smoothness.

Figure 18:
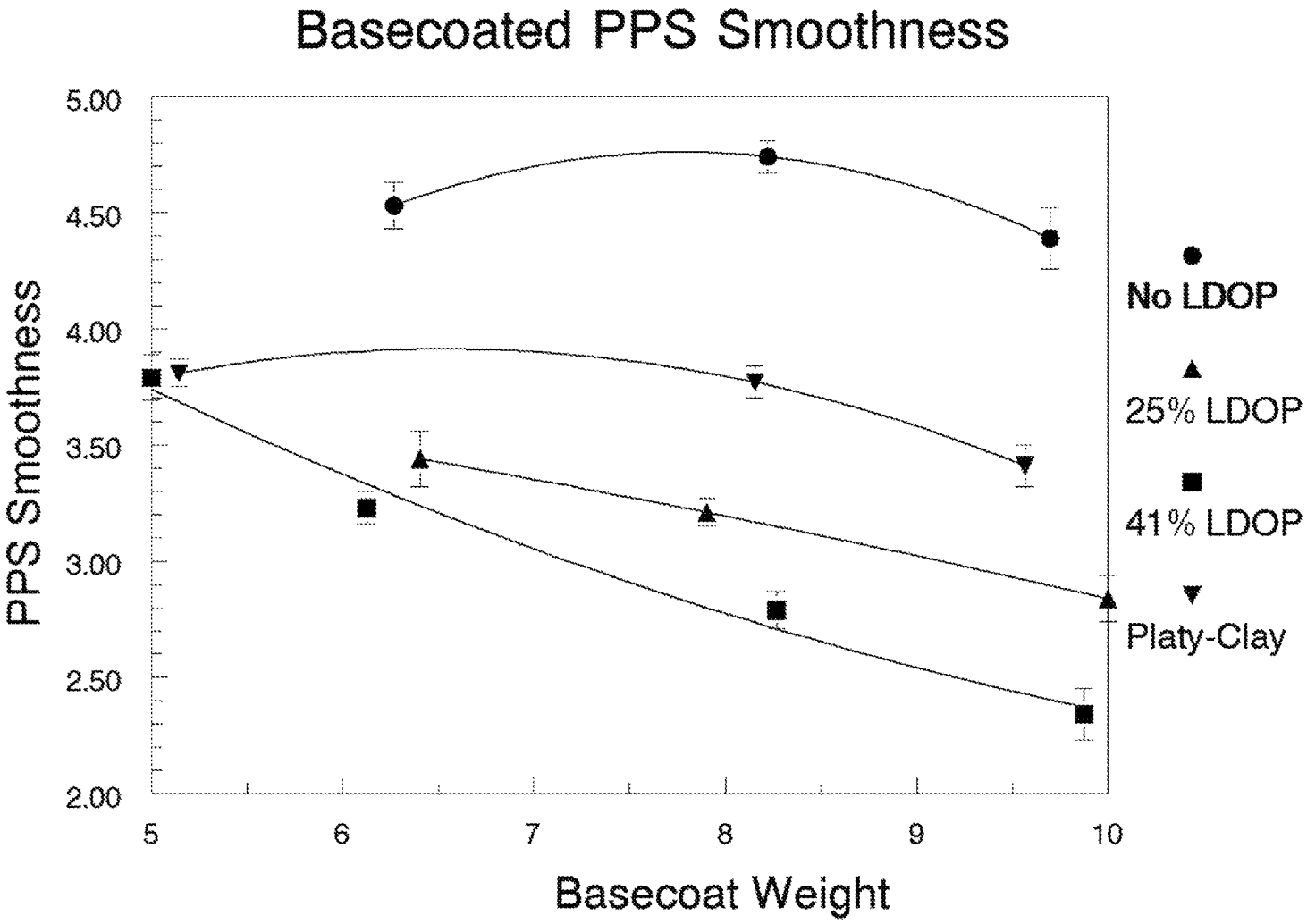
FIG. 18 illustrates the effect of coat weight and LDOP concentration on PPS smoothness for based coated samples.

PrintSurf results are listed in Table 8 and illustrated in FIG. 18. Measurements were made using a Technidyne Profile Plus instrument. From the roughest (greatest PPS, top of FIG. 18) to the smoothest (lowest PPS, bottom of FIG. 18), the samples tested as follows "Standard" formulation with no LDOP gave PPS values of 4.4μ to 4.7μ

"Platy-clay" formulation with no LDOP gave PPS values of 3.4μ to 3.8μ

The formulation having 25% LDOP gave PPS values of 2.8μ to 3.4μ

The formulation having 41% LDOP gave PPS values of 2.3μ to 3.8μ.

Particularly with the formulations containing LDOP, the smoothness improved (PPS decreased) as coat weight was increased. The samples with the basecoats containing LDOP were smoother than the standard or the platy-clay base coats. At coat weights above 6 lbs (9.8 $g/m^2$), the LDOP samples were about 1.5μ smoother than the samples with standard basecoats, and about 0.7μ smoother than samples with platy-clay basecoats.

Figure 19:
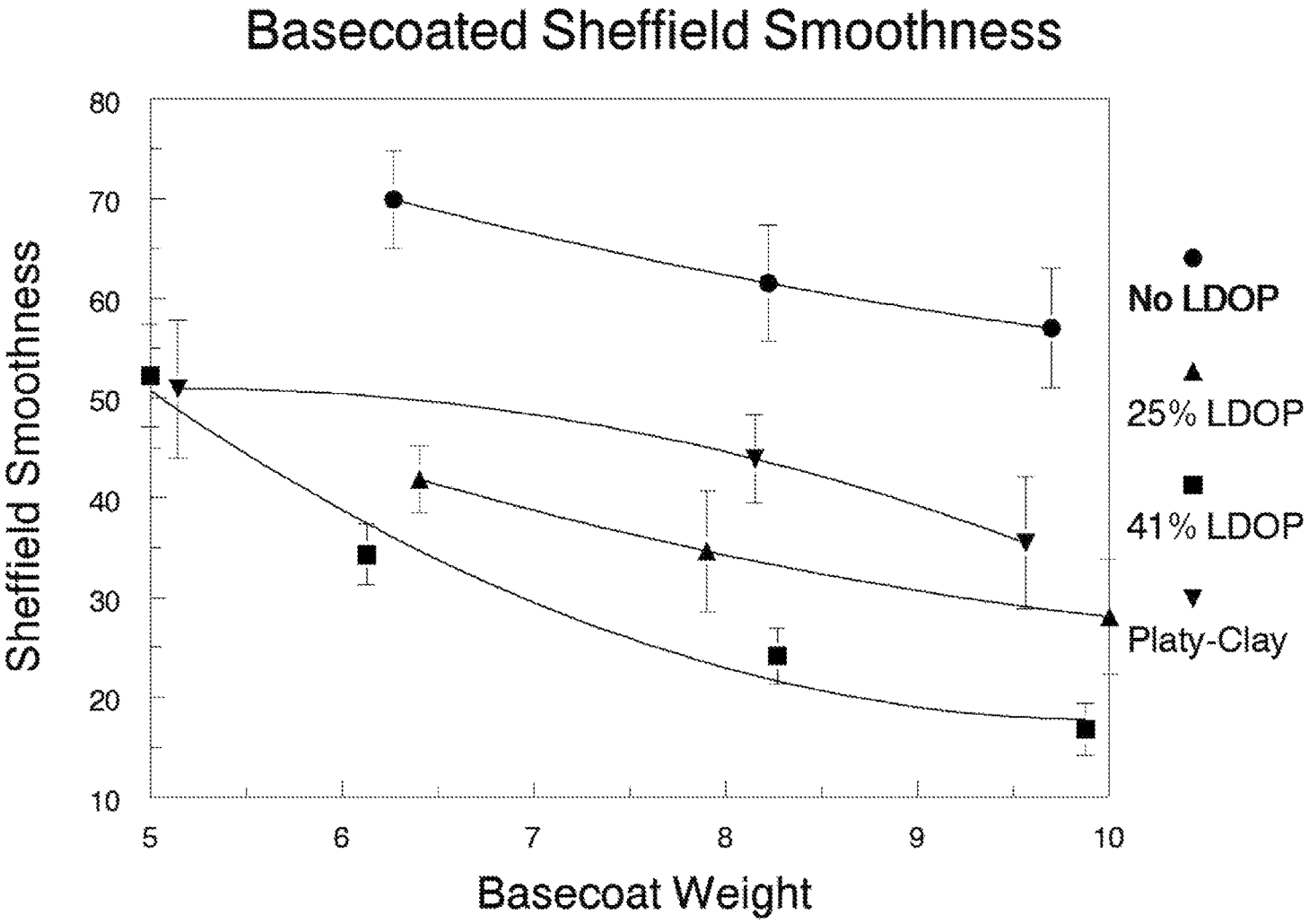
FIG. 19 illustrates the effect of coat weight and LDOP concentration on Sheffield smoothness for based coated samples.

For the same samples, Sheffield smoothness results are listed in Table 8 and illustrated in FIG. 19. Measurements were made using a Technidyne Profile Plus instrument. From the roughest (greatest Sheffield, top of FIG. 19) to the smoothest (lowest Sheffield, bottom of FIG. 19), the samples tested as follows "Standard" formulation with no LDOP gave Sheffield of 57 to 70

"Platy-clay" formulation with no LDOP gave Sheffield of 36 to 51

The formulation having 25% LDOP gave Sheffield 28 to 42

The formulation having 41% LDOP gave Sheffield 17 to 52

The smoothness improved (Sheffield decreased) as coat weight increased. The samples with the basecoats containing LDOP were smoother than the standard or the platy-clay base coats. At coat weights above 6 lbs (9.8 $g/m^2$), the LDOP samples were about 30-35 Sheffield units smoother than the samples with standard basecoats, and about 8-15 Sheffield units smoother than samples with platy-clay basecoats.

Samples having been base-coated with the various formulations of Table 6 were then top coated with the single formulation of Table 7, at 400 fpm (2.0 m/sec) using a bent-blade coater. For each of the four base coat formulations, several base coat weights and several top coat weights were run. For the resulting (uncalendared) top-coated samples, Table 9 shows the Parker PrintSurf (PPS) results. To best compare the samples, the results were regressed to calculated PPS values normalized to 8 lb/3000 $ft^2$ (13.0 $g/m^2$) base coat and 6 lb/3000 $ft^2$ (9.8 $g/m^2$) top coat. The results are given on FIG. 20, which shows "Standard" formulation with no LDOP gave PPS value of 2.6μ

"Platy-clay" formulation with no LDOP gave PPS value of 2.0μ.

The formulation having 25% LDOP gave PPS values of 1.85μ

The formulation having 41% LDOP gave PPS values of 1.7μ

In summary, the results of PART II show that a based-coated paperboard with improved smoothness relative to typical basecoats or platy-clay basecoats is achieved by the inventive coating. When top-coated, the improvement in smoothness is maintained. Presumably the improvement in smoothness would be maintained if more than one coating is applied over the base coat (for example, a second coat and a third coat).

Based on the results of PART I and PART II, it appears that coatings with high void volumes give improved smoothness. FIGS. 10-12 show that where LDOP is used in certain single-coat applications, the Parker PrintSurf typically improves (decreases) as the percent LDOP in the single coating is increased. FIG. 16 shows that percent void volume generally increases as the LDOP in the single coating increases. Thus, high void volumes in the single coating are associated with improved smoothness.

Figure 20:
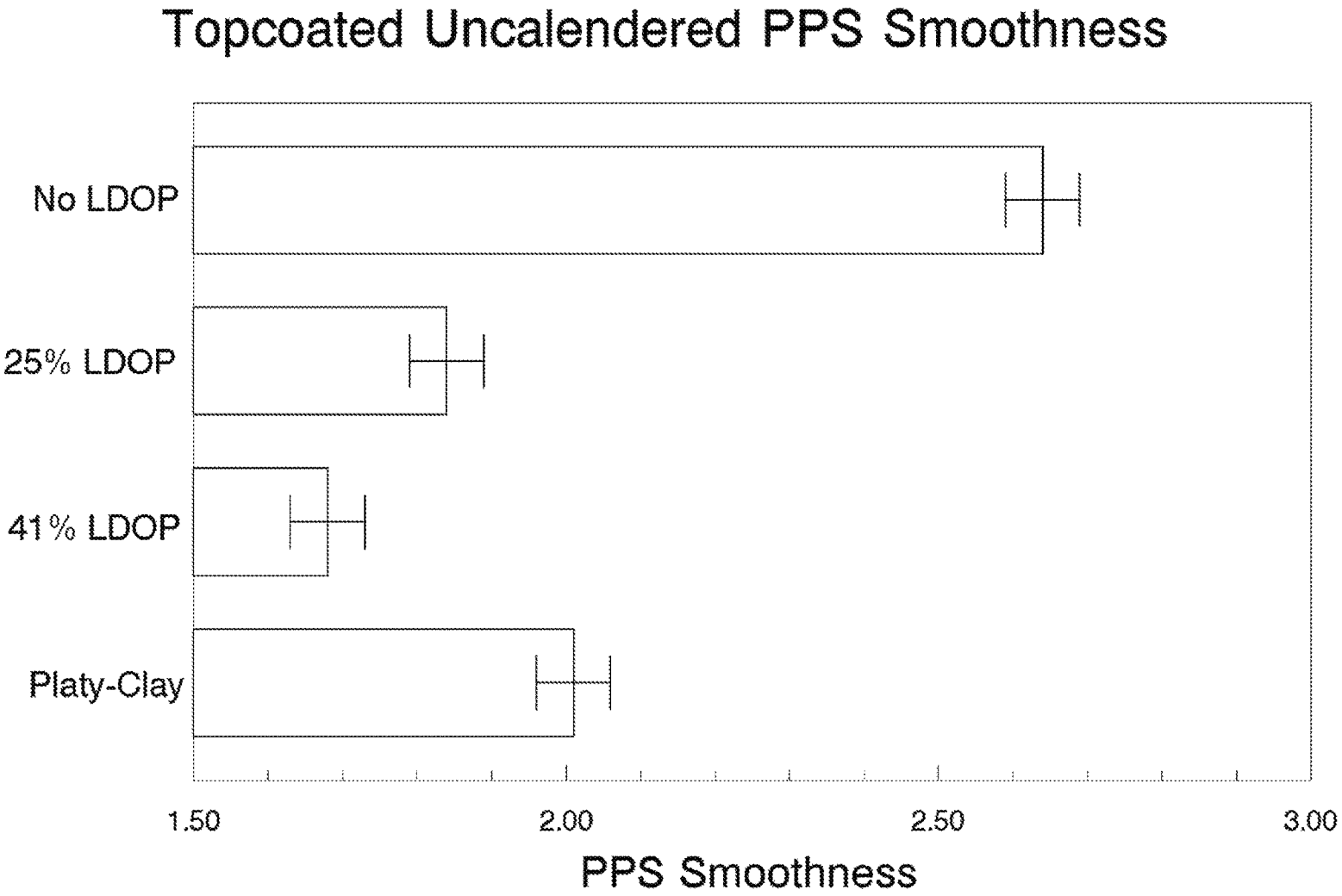
FIG. 20 illustrates the effect of LDOP concentration on PPS smoothness of top coated, uncalendered samples.

Likewise, FIGS. 18-20 show that where LDOP is used in the base coat, the Parker PrintSurf typically improves (decreases) in both the base coated condition and the top coated condition, as the percent LDOP in the base coating is increased. FIG. 17 shows that the percent void volume generally increases as the LDOP in the base coating increases. Thus, high void volumes in the base coating are associated with improved smoothness.

The tests described above used a blade coater to apply coating. As previously discussed, various types of coating devices may be used.

Once given the above disclosure, many other features, modifications or improvements will become apparent to the skilled artisan. Such features, modifications or improvements are, therefore, considered to be a part of this invention, the scope of which is to be determined by the following claims.

While preferred embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

TABLE 1

Pigment Percentage (by volume) for Coating Formulations A-P

| ID | Barrisurf HX | Hydrocarb 60 | ROPAQUE AF-500 | ROPAQUE OP 96 | ROPAQUE AF-1055 | ROPAQUE AF-1353 | ROPAQUE TH-2000 | Hydrocarb 90 | Hydrafine 91 |
|---|---|---|---|---|---|---|---|---|---|
| A | | 100.0 | | | | | | | |
| B | | | | | | | | 75.0 | 25.0 |
| C | 50.0 | 50.0 | | | | | | | |
| D | 50.0 | | 50.0 | | | | | | |
| E | 50.0 | | | 50.0 | | | | | |
| F | 50.0 | | | | 50.0 | | | | |
| G | 50.0 | | | | | 50.0 | | | |
| H | 50.0 | | | | | | 50.0 | | |
| I | 100.0 | | | | | | | | |
| J | 88.0 | | | | 12.0 | | | | |
| K | 76.0 | | | | 24.0 | | | | |
| L | 63.6 | | | | 36.4 | | | | |
| M | 56.8 | | | | 43.2 | | | | |
| N | 43.2 | | | | 56.8 | | | | |
| O | 50.0 | 25.0 | | | | | 25.0 | | |
| P | 50.0 | | | | | | 40.0 | 10.0 | |

TABLE 2

Ink Gloss of Calendared Samples (Coating formulations A-P)

| Sample | Ink Gloss | Standard Deviation |
|---|---|---|
| A | 19.2 | 0.74 |
| B | 26.1 | 0.42 |
| C | 28.9 | 0.74 |
| D | 40.9 | 0.25 |
| E | 47.7 | 0.75 |
| F | 53.9 | 1.03 |
| G | 56.4 | 1.65 |
| H | 53.0 | 1.53 |
| I | 36.9 | 0.41 |
| J | 38.2 | 1.49 |
| K | 46.0 | 0.94 |
| L | 55.4 | 0.77 |
| M | 54.3 | 1.46 |
| N | 51.9 | 1.29 |
| O | 36.6 | 0.71 |
| P | 47.8 | 1.14 |

TABLE 3

Smoothness (PPS) of Calendered Samples from Formulations A-P

| Coating ID | Coat Weight | Calendered PPS | Standard Deviation |
|---|---|---|---|
| A | 7.2 | 4.97 | 0.14 |
| | 8.5 | 4.65 | 0.14 |
| | 9.9 | 4.25 | 0.14 |
| B | 6.8 | 5.07 | 0.12 |
| | 7.9 | 4.96 | 0.19 |
| | 8.9 | 4.83 | 0.20 |
| | 10.1 | 4.63 | 0.19 |
| C | 7.1 | 2.39 | 0.05 |
| | 8.2 | 2.25 | 0.08 |
| | 9.3 | 2.21 | 0.09 |
| D | 5.8 | 3.29 | 0.09 |
| | 9.8 | 2.84 | 0.11 |
| E | 5.6 | 2.73 | 0.14 |
| | 10.2 | 2.31 | 0.07 |
| | — | — | — |
| F | 6.8 | 2.20 | 0.08 |
| | 8.2 | 2.07 | 0.05 |
| | 9.9 | 1.91 | 0.06 |

TABLE 3-continued

Smoothness (PPS) of Calendered Samples from Formulations A-P

| Coating ID | Coat Weight | Calendered PPS | Standard Deviation |
|---|---|---|---|
| G | 6.8 | 1.92 | 0.05 |
| | 8.2 | 1.92 | 0.09 |
| | 9.4 | 1.93 | 0.09 |
| H | 6.9 | 2.13 | 0.06 |
| | 8.1 | 2.08 | 0.08 |
| | 9.3 | 2.04 | 0.07 |
| I | 7.3 | 2.85 | 0.12 |
| | 8.80 | 2.77 | 0.1 |
| | — | — | — |
| J | 7.1 | 2.66 | 0.21 |
| | 8.6 | 2.47 | 0.08 |
| | 10.1 | 2.50 | 0.07 |
| K | 6.7 | 2.34 | 0.05 |
| | 8.1 | 2.24 | 0.07 |
| | 9.6 | 2.20 | 0.06 |
| L | 6.1 | 2.31 | 0.16 |
| | 7.4 | 2.21 | 0.08 |
| | 9.4 | 2.09 | 0.10 |
| M | 5.9 | 2.26 | 0.06 |
| | 7.0 | 2.08 | 0.10 |
| | 8.6 | 1.97 | 0.10 |
| N | 5.0 | 2.55 | 0.14 |
| | 6.3 | 2.27 | 0.07 |
| | 7.7 | 2.05 | 0.05 |
| O | 7.0 | 2.09 | 0.08 |
| | 7.9 | 2.01 | 0.10 |
| | 10.0 | 1.97 | 0.07 |
| P | 5.7 | 2.40 | 0.07 |
| | 7.3 | 2.10 | 0.07 |
| | 8.8 | 1.99 | 0.08 |

TABLE 4

Void Volume Percentages (* = Grades of Ropaque LDOP)

| ID | Barrisurf HX | Hydrocarb 60 | *AF-500 EF | *OP-96 | *AF-1055 | *AF-1353 | *TH-2000AF | Latex | Void Vol % | Std Dev |
|---|---|---|---|---|---|---|---|---|---|---|
| P1 | 100 | | | | | | | 8 | 45.4 | 0.6 |
| P2 | | 100 | | | | | | 8 | 38.0 | 0.3 |
| P3 | 75 | 25 | | | | | | 8 | 48.2 | 0.1 |
| P4 | 50 | 50 | | | | | | 8 | 48.4 | 0.3 |
| P5 | 25 | 75 | | | | | | 8 | 43.8 | 0.3 |
| P6 | 80 | | 20 | | | | | 8 | 45.2 | 0.5 |
| P7 | 60 | | 40 | | | | | 8 | 43.9 | 0.9 |
| P8 | 50 | | 50 | | | | | 8 | 43.6 | 0.3 |
| P9 | 40 | | 60 | | | | | 8 | 42.6 | 0.5 |
| P10 | 20 | | 80 | | | | | 8 | 40.8 | 1.6 |
| P11 | 0 | | 100 | | | | | 20 | Crazing | |
| P12 | 80 | | | 20 | | | | 8 | 47.5 | 0.7 |
| P13 | 60 | | | 40 | | | | 8 | 47.9 | 1.1 |
| P14 | 50 | | | 50 | | | | 8 | 46.5 | 0.2 |
| P15 | 40 | | | 60 | | | | 8 | 45.1 | 0.2 |
| P16 | 20 | | | 80 | | | | 8 | 43.1 | 1.6 |
| P17 | 0 | | | 100 | | | | 20 | Crazing | |
| P18 | 80 | | | | 20 | | | 8 | 48.1 | 0.5 |
| P19 | 60 | | | | 40 | | | 8 | 49.1 | 0.3 |
| P20 | 50 | | | | 50 | | | 8 | 49.2 | 0.9 |
| P21 | 40 | | | | 60 | | | 8 | 48.7 | 0.8 |
| P22 | 20 | | | | 80 | | | 8 | 45.6 | 1.0 |
| P23 | 0 | | | | 100 | | | 20 | 39.1 | 0.5 |
| P24 | 80 | | | | | 20 | | 8 | 47.9 | 0.5 |
| P25 | 60 | | | | | 40 | | 8 | 50.4 | 1.2 |
| P26 | 50 | | | | | 50 | | 8 | 49.9 | 0.8 |
| P27 | 40 | | | | | 60 | | 8 | 50.3 | 1.2 |
| P28 | 20 | | | | | 80 | | 8 | 48.6 | 0.5 |
| P29 | 0 | | | | | 100 | | 20 | 42.5 | 1.5 |
| P30 | 80 | | | | | | 20 | 8 | 48.2 | 0.1 |
| P31 | 60 | | | | | | 40 | 8 | 52.8 | 1.1 |
| P32 | 50 | | | | | | 50 | 8 | 53.6 | 0.6 |
| P33 | 40 | | | | | | 60 | 8 | 54.6 | 1.0 |
| P34 | 20 | | | | | | 80 | 8 | 55.5 | 0.9 |
| P35 | 0 | | | | | | 100 | 20 | 40.6 | 0.0 |

TABLE 5

Void Volume Percentages: Selected Samples from Table 4

| ID | Barrisurf HX | Hydrocarb 60 | ROPAQUE *F-1353 | Latex | Void Volume | Standard Deviation |
|---|---|---|---|---|---|---|
| P4 | 50 | 50 | | 8 | 48.4 | 0.3 |
| P34 | 50 | 40 | 10 | 8 | 47.1 | 0.3 |
| P35 | 50 | 30 | 20 | 8 | 48.2 | 0.0 |
| P36 | 50 | 20 | 30 | 8 | 49.1 | 0.8 |
| P37 | 50 | 10 | 40 | 8 | 49.2 | 0.7 |
| P26 | 50 | 50 | | 8 | 49.9 | 0.8 |

TABLE 6

Base Coat Formulations

| | Q "Standard" No LDOP | R 25% LDOP | S 41% LDOP | T "platy clay" No LDOP |
|---|---|---|---|---|
| LDOP (volume) | 0% | 25% | 41% | 0% |
| XP6170 | | | | 50 |
| Ropaque AF-1353 | | 5.8 | 11.6 | |
| Hydrocarb 60 | 100 | 94.2 | 88.4 | 50 |
| Rhoplex P-308 | 18 | 18 | 18 | 17 |
| Resyn 1103 | | | | 4 |

TABLE 7

Top Coat Formulation

| | |
|---|---|
| Hydrocarb 90 | 80 |
| Kaofine 91 | 20 |
| Polyco 2160 | 12 |
| Selvol 203S | 1.6 |

TABLE 8

Smoothness of Base Coated Samples

| | BC Wgt | PPS | stdev | Sheffield | stdev |
|---|---|---|---|---|---|
| Q | 6.3 | 4.53 | 0.1 | 70 | 4.9 |
| "Standard" | 8.2 | 4.74 | 0.07 | 62 | 5.8 |
| | 9.7 | 4.39 | 0.13 | 57 | 6.0 |
| R | 6.4 | 3.44 | 0.12 | 42 | 3.4 |
| 25% LDOP | 7.9 | 3.21 | 0.06 | 35 | 6.1 |
| | 10.0 | 2.84 | 0.1 | 28 | 5.8 |
| S | 5.0 | 3.79 | 0.1 | 52 | 5.2 |
| 41% LDOP | 6.1 | 3.23 | 0.07 | 34 | 3.1 |
| | 8.3 | 2.79 | 0.08 | 24 | 2.8 |
| | 9.9 | 2.34 | 0.11 | 17 | 2.6 |
| T | 5.1 | 3.81 | 0.06 | 51 | 6.9 |
| "platy | 8.2 | 3.77 | 0.07 | 44 | 4.4 |
| clay" | 9.6 | 3.41 | 0.09 | 36 | 6.6 |

TABLE 9

| Smoothness of Top Coated Samples | | | | |
|---|---|---|---|---|
| Basecoat | Basecoat Coat Weight | Topcoat Coat Weight | PPS | stdev |
| Basecoat Q "Standard" | 8.2 | 5.5 | 2.58 | 0.04 |
| | 8.2 | 7.3 | 2.74 | 0.05 |
| | 9.7 | 5.0 | 2.33 | 0.05 |
| | 9.7 | 7.0 | 2.60 | 0.06 |
| Basecoat R 25% LDOP | 7.9 | 5.4 | 1.73 | 0.04 |
| | 7.9 | 6.5 | 1.94 | 0.04 |
| | 7.9 | 7.5 | 2.12 | 0.04 |
| | 10.0 | 5.0 | 1.57 | 0.04 |
| | 10.0 | 6.6 | 1.91 | 0.05 |
| Basecoat S 41% LDOP | 6.1 | 5.2 | 1.76 | 0.05 |
| | 6.1 | 6.4 | 1.89 | 0.06 |
| | 6.1 | 7.9 | 2.06 | 0.03 |
| | 8.3 | 6.0 | 1.65 | 0.07 |
| | 8.3 | 7.2 | 1.82 | 0.05 |
| Basecoat T "platy clay" | 5.1 | 5.3 | 1.89 | 0.06 |
| | 5.1 | 6.9 | 1.98 | 0.05 |
| | 8.2 | 6.2 | 2.05 | 0.05 |
| | 8.2 | 7.0 | 2.19 | 0.04 |

What is claimed:

1. A coated paperboard comprising:

a paperboard substrate having a caliper thickness of at least 10 mils; and single layer of coating comprising a pigment blend comprising a hyperplaty clay with an aspect ratio of at least 60:1 and a low density organic pigment, wherein the low density organic pigment comprises up to 40%, by volume, of the pigment blend; and sufficient binder to adhere the coating to the paperboard;

wherein the single layer of coating has a dry weight of less than 10 lbs per 3000 $ft^2$; and the coated paperboard has a Parker PrintSurf smoothness value of not more than 2.5 microns.

2. The coated paperboard of claim 1, wherein the low density organic pigment has a particle diameter greater than 0.6 microns.

3. The coated paperboard of claim 1, wherein the hyperplaty clay comprises by volume at least 20% of the pigment blend.

4. The coated paperboard of claim 1, wherein the hyperplaty clay and low density organic pigment comprise by volume at least 50% of the pigment blend.

5. The coated paperboard of claim 1, wherein the pigment blend further comprises ground calcium carbonate.

6. The coated paperboard of claim 1, wherein the low density organic pigment comprises hollow spheres.

7. The coated paperboard of claim 1, wherein the low density organic pigment is substantially non-expanding during drying of the coating.

8. The coated paperboard of claim 1, wherein the single layer of coating has a dry weight of less than 9 lbs per 3000 $ft^2$.

9. The coated paperboard of claim 8, wherein the single layer of coating has a dry weight of less than 8 lbs per 3000 $ft^2$.

10. The coated paperboard of claim 1, wherein the coated paperboard has a Parker PrintSurf smoothness value of not more than 2.25 microns.

11. The coated paperboard of claim 10, wherein the coated paperboard has a Parker PrintSurf smoothness value of not more than 2.0 microns.

12. The coated paperboard of claim 1, wherein the caliper thickness is at least 12 mils.

13. The coated paperboard of claim 1, wherein the hyperplaty clay and low density organic pigment comprise by volume at least 60% of the pigment blend.

14. The coated paperboard of claim 1, wherein the hyperplaty clay and low density organic pigment comprise by volume at least 75% of the pigment blend.

15. The coated paperboard of claim 1, wherein the hyperplaty clay and low density organic pigment comprise by volume at least 90% of the pigment blend.

16. The coated paperboard of claim 1, wherein the hyperplaty clay and low density organic pigment comprise 100% of the pigment blend.

17. The coated paperboard of claim 1, wherein the hyperplaty clay comprises by volume at least 30% of the pigment blend.

18. The coated paperboard of claim 1, wherein the hyperplaty clay comprises by volume at least 50% of the pigment blend.

19. The coated paperboard of claim 1, wherein the hyperplaty clay comprises by volume at least 60% of the pigment blend.

20. The coated paperboard of claim 1, wherein the low density organic pigment comprises by volume at least 30% of the pigment blend.

21. The coated paperboard of claim 1, wherein the low density organic pigment comprises by volume up to 30% of the pigment blend.

* * * * *